US006336993B1

(12) United States Patent
Stromberg

(10) Patent No.: US 6,336,993 B1
(45) **Date of Patent: *Jan. 8, 2002**

(54) METAL REMOVAL FROM COMMINUTED FIBROUS MATERIAL DURING FEEDING

(75) Inventor: C. Bertil Stromberg, Glens Falls, NY (US)

(73) Assignee: Andritz-Ahlstrom Inc., Glens Falls, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/568,962

(22) Filed: May 11, 2000

Related U.S. Application Data

(63) Continuation-in-part of application No. 09/063,429, filed on Apr. 21, 1998, now Pat. No. 6,106,668, which is a continuation-in-part of application No. 08/738,239, filed on Oct. 25, 1996, now Pat. No. 5,753,075.

(51) Int. Cl.[7] ..... D21C 9/00; D21C 11/00

(52) U.S. Cl. ..... 162/10; 162/29; 162/52; 162/56

(58) Field of Search ..... 162/52, 56, 10, 162/29

(56) References Cited

U.S. PATENT DOCUMENTS 5,447,603 A * 9/1995 Michalowski et al. ... 162/181.4
5,571,378 A * 11/1996 Elofson et al. ..... 162/65
5,753,075 A * 5/1998 Stromberg et al. ..... 162/52
6,106,668 A * 8/2000 Stromberg et al. ..... 162/52

* cited by examiner

*Primary Examiner*—Christopher A. Fiorilla
(74) *Attorney, Agent, or Firm*—Nixon & Vanderhye P.C.

(57) ABSTRACT

A system and method for feeding a slurry of comminuted cellulosic fibrous material such as wood chips to the top of a treatment vessel such as a continuous digester also treat the material to remove metals before digestion. During pumping of the slurry with at least first and second series connected pumps, at or upstream of at least one of the pumps chemicals (acids and/or chelating agents) which dissolve the metals in the material are added, and preferably some of the liquid is removed so as to purge at least about 10% (e.g. about 20–80%) of the metals in the material. The metal removal preferably takes place substantially immediately before alkaline digestion.

22 Claims, 8 Drawing Sheets

CHIPS
PIC
80
20
81
84
82
82'
710
782
85
89
86
88
92
90
790
788
887
824
822
860
888
823
821
810
826
825
854
850
851
889
886
912
890
892
610
988
911
922
987
921
910
960
950
951
986
989
914
913
991
990
992
915

METAL REMOVAL FROM COMMINUTED FIBROUS MATERIAL DURING FEEDING

CROSS-REFERENCE TO RELATED APPLICATIONS

This application is a continuation-in-part of application Ser. No. 09/063,429 filed Apr. 21, 1998, now U.S. Pat. No. 6,106,668 which in turn is a continuation-in-part of Ser. No. 08/738,239 filed Oct. 25, 1996, now U.S. Pat. No. 5,753,075.

BACKGROUND AND SUMMARY OF THE INVENTION

This invention relates to a method and system for feeding comminuted cellulosic fibrous material to a treatment vessel, such as a continuous digester. The invention simplifies and dramatically reduces the number of components needed when compared to the existing art.

U.S. Pat. Nos. 5,476,572, 5,622,598 and 5,635,025 and 5,766,418 introduced the first real breakthroughs in the art of feeding comminuted cellulosic fibrous material to a treatment vessel in over forty years. These patents and the application disclose several embodiments, collectively marketed under the trademark Lo-Level® feed system by Ahlstrom Machinery Inc. of Glens Falls, N.Y., for feeding a digester using a slurry pump, among other components. As described in these patents and application, using such a pump to feed a slurry to a high-pressure transfer device dramatically reduces the complexity and physical size of the system needed, and increases the ease of operability and maintainability. The prior art systems employing a high-pressure transfer device, for example a High-Pressure Feeder as sold by Ahlstrom Machinery Inc., but without such a pump, are essentially unchanged from the systems sold and built since the 1940s and 1950s.

The present invention relates to an even more dramatic improvement to the methods and systems disclosed in the above-mentioned patent and applications. The present invention actually eliminates the need for transfer devices, such as a High-Pressure Feeder, by using high-pressure pumping devices to transfer a slurry of comminuted cellulosic fibrous material directly to a digester.

The reaction of pulping chemicals with comminuted cellulosic fibrous material to produce a chemical pulp requires temperatures ranging between 140–180° C. Since the aqueous chemicals used to treat the material would boil at such temperatures, commercial chemical pulping is typically performed in a pressure-resistant vessel under pressures of at least about 10 bars gauge (approximately 150 psi gauge). In order to maintain this pressure, especially when performing a continuous pulping process, special accommodations must be made to ensure that the pressure is not lost when introducing material to the pressure vessel. In the prior art this was accommodated by what is known in the art as a "High-Pressure Feeder". This feeder is a specially-designed device containing a pocketed rotor which acts as a means for transferring a slurry of material from a low pressure to a high pressure while also acting as a valve for preventing loss of pressure. This complicated and expensive device has long been recognized as an essential component for introducing slurries of comminuted cellulosic material to pressurized vessels, typically at elevated temperatures, especially to continuous digesters.

According to the invention a system which replaces the High-Pressure Feeder—which has been recognized for over forty years as being essential to continuous digesting—is provided, greatly simplifying construction of a pulp mill.

According to one aspect, a system for producing chemical cellulose pulp from comminuted fibrous cellulose material, such as wood chips, comprises the following components: A steaming vessel in which comminuted fibrous cellulose material is steamed to remove the air therefrom. A superatmospheric pressure vertical treatment vessel having an inlet for a slurry of comminuted cellulose fibrous material at a top portion thereof and an outlet at a bottom portion thereof. And, pressurizing transfer means for pressurizing a slurry of material from the steaming vessel and transferring it to the treatment vessel inlet, the pressurizing transfer means consisting of one or more high pressure slurry pumps located below the top portion of the treatment vessel.

The one or more pumps preferably comprises first and second high pressure slurry pumps connected in series and each having a pressure rating, an inlet and an outlet, the first pump inlet operatively connected to the steaming vessel, the first pump outlet operatively connected to the second pump inlet, and the second pump having a higher pressure rating than the first pump. The slurry pumps may be helical screw centrifugal pumps, double-piston solids pumps, or other similar conventional pumping devices that are capable of pressurizing a slurry having a relatively high percentage of solids to (in one or more stages) a pressure of at least about 5 bar gauge. The pressurizing and transferring may also be effected by an one or more eductors, of conventional construction, driven by a pressurized fluid supply, such as supplied by conventional centrifugal pump.

One typical unit of measure that indicates the relative amount of solids in a slurry containing solids and liquid is the "liquid-to-solids ratio". In this application, this ratio is the ratio of the volume of liquid being transferred to the volume of cellulose, or wood, material being transferred. Typical conventional centrifugal liquid pumps are limited to pumping liquid having a solids content of at most 3%. This 3% solids content corresponds to a liquid-to-solids ratio of about 33. In the slurry pumps of this invention, the liquid-to-solids ratio of the slurry being pumped is typically between 2 and 10, preferably between 3 and 7, and most preferably between 3 and 6. In other words, the slurry pumps of this invention transfer slurries having a much greater solids content than can be handled by a conventional pump.

A liquid return line may be provided from the top portion of the treatment vessel, containing liquid separated from the slurry at the top of the treatment vessel (preferably a continuous digester). The return line may be operatively connected to an inlet or outlet of one of the slurry pumps, either directly or indirectly. Preferably the liquid return line is connected to a pressure reduction means for reducing the pressure of liquid in the return line before the liquid passes to the inlet or outlet of the slurry pump. The pressure reduction means may take a variety of forms, such as a flash tank and/or a pressure control valve in the return line, or other conventional structures for effectively reducing the pressure of liquid in a line while not adversely affecting the liquid. Where a flash tank is utilized the liquid outlet from the flash tank is connected to the inlet to the first slurry pump, and the steam produced by the flash tank may be used in the steaming vessel.

Alternatively, the pressure reduction may be effected, or even avoided, by using an eductor which uses the pressurized return line liquor as its source of pressurized fluid. An eductor may be used in place of or in conjunction with one or more of the slurry pumps, or other devices, to transfer slurry to the digester.

A conventional chute, as well as other optional components, is preferably connected between the steaming vessel and the at least one slurry pump, the steaming vessel being located above the chute and the chute above the at least one slurry pump. The at least one slurry pump is typically located a distance at least 30 feet (about 10 meters) below the top of the digester, and typically more than about 50 feet (about 15 meters) below.

When the high pressure transfer device is eliminated it is desirable to utilize other mechanisms to retain one of the functions of the high pressure transfer device, namely providing pressure relief prevention should an aberrant condition occur, the high pressure transfer device typically preventing backflow of liquid from the digester into the feed system. Pressure relief preventing means according to the present invention are preferably distinct from the at least one slurry pump, although under some circumstances the inlets to or outlets from the slurry pumps may be constructed in a manner so as to provide pressure relief prevention. The pressure relief preventing means may comprise an automatic isolation valve in each of the slurry conduits transferring slurry from the pumps to the top of the treatment vessel and the return line from the treatment vessel, a conventional controller being provided connected to the isolation valves and operating the isolation valves in response to the pressure sensed by a pressure sensor associated with the slurry conduit feeding slurry to the top of the treatment vessel. The pressure relief preventing means may also comprise a check valve in the slurry conduit, and/or a variety of other valves, tanks, sensors, controllers, or like fluidic, mechanical, or electrical components which can perform the pressure relief preventing function.

The system may also comprise means for augmenting the flow of liquid to the inlet to the second slurry pump, or to any pump or transfer device, such as a liquid line having liquid at a pressure below the pressure at the second slurry pump inlet, a conduit between the liquid line and the inlet, and a liquid pump in the conduit. The liquid line may be the return line from the treatment vessel, and the conduit may be connected directly to the return line. The liquid return line may be connected to a flash tank as described above, and the conduit may be connected to the flash tank liquid outlet.

According to another aspect, a method of feeding comminuted cellulosic fibrous material to the top of a treatment vessel is provided. The method comprises the steps of: (a) Steaming the material to remove air therefrom and to heat the material. (b) Slurrying the material with a cooking liquor to produce a slurry of liquid and material. And, (c) pressurizing the slurry to a pressure of at least about 5 bar gauge at a location below the top of the treatment vessel (e.g. at least thirty feet below, preferably at least fifty feet below), and transferring pressurized material to the top of the treatment vessel, the pressurizing step consisting of acting on the slurry with one or more high pressure slurry pumps.

The method may comprise the further steps of: (d) returning liquid separated from the slurry at the top of the treatment vessel to the at least one pump; and (e) sensing the pressure of the slurry while being transferred to the top of the treatment vessel, and shutting off the flow of slurry to the top of the treatment vessel and the return of liquid from the top of the vessel if the sensed pressure drops below a predetermined value. There also may be the step (f) of flashing the liquid while returning in the practice of step (d) to produce steam, and using the steam in the practice of step (a).

In an additional embodiment, the concept of transferring a slurry of chips is extended back to the point where chips are introduced to the mill, that is, the Woodyard. Conventional pulp mills receive their supply of cellulose material, typically hardwood and softwood but other forms of cellulose material as described above may be handled, in various forms. These include as sawdust, as chip, as logs, as long de-limbed trees (that is, "long wood"), or even as complete trees (that is, "whole trees"). Depending upon the source of cellulose of the "wood supply", the wood is typically reduced to chip form so that it can be handled and treated in a pulping process. For example, devices known as "chippers" reduce the long-wood or logs to chips that are typically stored in open chip piles or chip silos. This receipt, handling, and storage of the chips is performed in an area of the pulp mill referred to as the "woodyard". From the Woodyard the chips are typically transferred to the pulp mill proper to initiate the pulping process.

In conventional Woodyards, the chips are stored in silos from which the chips are discharged, typically by means of a rotating or vibrating silo discharge device, to a conveyor. This conveyor is typically a belt-type conveyor which receives the chips and transfers them to the pulping treatment vessels. Since the Woodyard is typically at a distance from the pulping vessels, this conveyor is typically long. Such conveyors may have a length of up to one-half mile. In addition, treatment systems that do not employ the Lo-Level™ feeding system, as marketed by Ahlstrom Machinery and described in U.S. Pat. Nos. 5,476,572, 5,622,598, 5,635,025 and 5,766,416, require that the conveyor be elevated, typically to a height of at least 100 feet, in order to feed the chips to the inlet of the first pulping vessel. These conveyers, and the structures that support them, are very expensive and contribute a significant cost to the cost of a digester feed system.

In another embodiment, the concept of transferring a slurry of chips is extended back to the Woodyard. A preferred embodiment of this invention consists of a method of transferring comminuted cellulosic fibrous material to a pulping process, consisting of the following steps: (a) Introducing untreated chips to a first vessel. (b) Introducing slurrying liquid to the first vessel to create a slurry of material and liquid. (c) Discharging the slurry from the vessel to the inlet of at least one pressurizing and transferring device. (d) Pressurizing the slurry in the pressurizing and slurrying device and transferring the slurry to a treatment vessel.

The first vessel is typically a chip storage silo or bin. This bin preferably has a discharge having one-dimensional convergence without agitation or vibration, such as a DIAMONDBACK® bin as described in U.S. Pat. No. 5,000,083, though agitation or vibration may be used. This bin may also have two or more outlets which feed two or more transfer devices. This vessel may also be operated at superatmospheric pressure, for example at 0.1 to 5 bar. If the vessel is operated at superatmospheric pressure some form of pressure isolation device must be located at the inlet of the vessel to prevent the release of pressure. This device may be a star-type isolation device, such as a Low-pressure Feeder or Air-lock Feeder as sold by Ahlstrom Machinery, or a screw-type feeder having a sealing capacity as described in U.S. Pat. No. 5,766,416.

The slurrying liquid may be any source of liquid available in the pulp mill, including fresh water, steam condensate, kraft white, black, or green liquor or sulfite liquor or any other pulping-related liquid. This liquid may be a heated fluid, for example, hot water or steam, having a temperature of between 50 and 100° C. If the vessel is a pressurized vessel, liquid temperatures of over 100° C. may be used. Though not essential, this liquid may contain at least some active pulping chemical, for example, sodium hydroxide (NaOH), sodium sulfide (Na2S), polysulfide, anthraquinone or their equivalents or derivatives or surfactants, enzymes or chelates, or combinations thereof.

The pressurizing and transferring device of steps (c) and (d) is preferably a slurry pump, or pumps, but many other pressurizing and transferring devices may be used such as the piston-type solids pump or a high-pressure eductor. Preferably, more than one pressurizing and slurrying pump is used to transfer the slurry. These may be two or more slurry pumps, or any combination of slurry pump, piston-type pump, or eductor. This transfer system may also include one or more storage or surge tanks as well as transfer devices. Preferably, the one or more transfer devices include at least one device having de-gassing capability so that undesirable air or other gases may be removed from the slurry. Also, during transfer, the chips may be exposed to some form of treatment, for example, de-aeration or impregnation with a liquid, preferably a liquid containing pulping chemicals, such as those described above. The slurry may also be exposed to at least one pressure change or fluctuation during transfer, for example, such that the pressure of the slurry is varied from a first pressure to a second, higher pressure, and then optionally to a third pressure which is lower than the second pressure. As described in U.S. Pat. Nos. 4,057,461 and 4,743,338 varying the pressure of a slurry of chips and liquor improves the impregnation of the chips by the liquor. This pressure pulsation may be achieved by varying the outlet pressure of a set of transfer devices in series, or by controlled depressurization of the slurry between pumping.

In another embodiment, the material need not encounter liquid in the vessel, but may have liquid first introduced to it by means of an eductor located in or below the outlet of the vessel. This liquid is preferably pressurized so that the material and liquid form a pressurized slurry of material and liquid.

The treatment vessel of step (d) may typically be a steaming vessel as described above, preferably a DIAMONDBACK® steaming vessel. The vessel may also be a storage or surge tank in which the material may be stored prior to treatment. Since the transfer process may require excess liquor that is not needed during treatment or storage, some form of de-watering device may be located between the transfer device and the treatment vessel. One preferred dewatering device is a Top Separator, as sold by Ahlstrom Machinery. This Top Separator may be a standard type or an "inverted" Top Separator. This device may be an external stand-alone-type unit or one that is mounted directly onto the treatment vessel. An In-line Drainer, also sold by Ahlstrom Machinery, may also be used for the dewatering device. Preferably, the liquid removed from the slurry by means of the de-watering device is returned to the first vessel or to the transfer devices to act as the slurring liquid. This liquid may also be used where ever needed in the pulp mill. This liquid may be heated or cooled as desired. For example, this liquid may be heated by passing it in indirect heat exchange relationship with any heated liquid stream, for example, a waste liquid stream having a temperatures greater than 50° C. This liquid will also typically be pressurized using one or more conventional centrifugal liquid pumps.

In one preferred embodiment the treatment vessel of step (d) is a steaming vessel which feeds one or more transfer devices as described above. Though this system is preferably used in conjunction with a feed system not having a conventional High-pressure Feeder, this system may also be used with a feed system having a High-pressure Feeder.

The method and apparatus for feeding chips from a distant location, for example, a Woodyard, to a pulping process is not limited to chemical pulping processes, but may be used in any pulping process in which comminuted cellulosic fibrous material is conveyed from one location to another. The pulping processes that this invention is applicable to include all chemical pulping processes, all mechanical pulping processes, and all chemi-mechanical pulping or thermal-mechanical pulping processes, for either batch or continuous treatment.

According to another aspect there is provided a method of feeding wood chips to the top of a treatment vessel comprising the steps of: (a) Steaming the wood chips to remove air therefrom and to heat the material. (b) Slurrying the wood chips with a cooking liquor to produce a slurry of liquid and material. (c) Pressurizing the slurry to a pressure of at least about 5 bar gauge at a location at least thirty feet below the top of the treatment vessel and transferring pressurized wood chips to the top of the treatment vessel, the pressurizing step consisting essentially of acting on the slurry with one or more high pressure slurry pumps. And, (d) during the practice of the transferring step (c), treating the wood chips with polysulfide, anthraquinone or their equivalents or derivatives, surfactants, enzymes, chelants, or combinations thereof.

Where the treatment vessel is upstream of a continuous or batch digester, step (c) is typically practiced downstream of the treatment vessel. There may also be the further step (e), before the continuous or batch digester and substantially immediately after steps (a) and (b), of pressurizing the slurry at a location at least 30 feet below the top of the digester, and transferring pressurized wood chips to the top of the digester, the pressurizing step consisting of acting on the slurry with one or more high pressure slurry pumps. There may also be the step of returning liquid removed from the digester to the treatment vessel, and adjusting the temperature of the liquid while returning it to the treatment vessel. The step of removing liquid from the treatment vessel typically takes place at the top of the treatment vessel.

The method may also comprise the further step of returning liquid from downstream of the treatment vessel to the treatment vessel, and adjusting the temperature of the liquid, and the step of adjusting the temperature of the liquid may take place by passing the liquid through an indirect heat exchanger. The method may also comprise the further step of returning liquid separated from the slurry at the top of the digester to the one or more slurry pumps, pressurizing the slurry to transfer it to the digester, and adjusting the temperature of the removed liquid during recirculation.

The system and method herein not only reduce the size and cost of the system for transferring comminuted cellulosic fibrous material, but if the comminuted cellulosic fibrous material is treated during transfer, the number and size of the formal treatment vessels may be reduced. For example, this system may eliminate the need for conventional pretreatment or impregnation vessels prior to the digester. This system also has the potential for improving the over-all energy economy of the pulp mill. This and other aspects of the invention will become manifest upon review of the detailed description and figure below.

According to another aspect a method of treating comminuted cellulosic fibrous material using at least first and second series connected pumps, and at least first and second in series stations each with a solids/liquid separator is provided. The method comprises the steps of: (a) Pumping a slurry of comminuted cellulosic fibrous material using the series connected pumps. (b) Separating some liquid from the slurry at each station to substantially isolate liquor circulations and streams, and to recirculate removed liquid from at least one of the stations to upstream of one of the pumps. And (c) adding chemicals to the slurry upstream of each of the pumps, the chemicals including at least some chemical selected from the group consisting essentially of sodium hydroxide, sodium sulfate; polysulfide, anthraquinone, or their equivalents or derivatives; surfactants, enzymes, or chelants; or combinations thereof; so that pre-treatment of the material occurs during transfer of the material from each pump to each station.

There may be the further step of degassing the slurry at at least one of the stations. At least first, second and third series connected pumps and stations may be provided; and there may also be the further steps of: (d) Circulating liquid removed from the third station to a location upstream of the second pump, and (e) circulating liquid removed form the second station to a location upstream of the first pump (step (d) may be practiced downstream of the first station). There may also be the further step of passing the removed liquid, during the practice of at least one of steps (d) and (e), through a heat exchanger to change the temperature thereof. For example, the temperature of the removed liquid may be increased or decreased by from about 1 to about 10° C., depending upon the volume of the liquid and the amount of heating or cooling available.

Step (c) may be practiced by adding a different chemical, or combination of chemicals, upstream of each pump, so that significantly different treatments of the material of the slurry take place during transfer of the slurry from each pump to its associated station. Step (a) may be practiced to pressurize the slurry to a pressure of at least 5 bar. Also, there may be the further step of removing liquid from at least one of the stations through an eductor (also known as an ejector) instead of a flash tank and/or control valve.

According to another aspect of this invention, one treatment that can be used during the transfer of comminuted cellulosic fibrous material is the removal of metal ions. It is recognized in the art that the presence of certain metallic compounds or ions, for example, those containing iron, calcium, manganese, and others, can interfere with pulping and bleaching reactions or can precipitate as undesirable "scale" on the treatment equipment. It is also known the metal content of the cellulose material can be reduced by exposing the material to acidic liquids which can dissolve metal compounds or ions or to acidic to slightly alkaline conditions in the presence of a chelating agent (also known as a sequestering agent) which combine with certain metals and make them more easily isolated and removed, for example, by washing. According to the present invention, these deleterious metal-containing compounds and ions are removed from the cellulose material prior to the cooking process and bleaching process so that these metals do not interfere with these processes nor form scale on the equipment used to effect these processes.

According to this aspect of the invention, there is provided a method of treating a slurry of comminuted cellulosic fibrous material using at least first and second series connected pumps, and at least first and second in-series stations, each with a solids/liquid separator, in which the metal content of the material is reduced. The method comprises: (a) Pumping a slurry of comminuted cellulosic fibrous material using the series connected pumps. (b) Separating some liquid from the slurry at each station to substantially isolate liquor circulations and streams, and to recirculate removed liquid from at least one of the stations to upstream of one of the pumps. And (c) adding chemicals which dissolve or sequester metal containing compounds to the slurry at or upstream of at least one of the pumps, the chemicals including at least one chemical selected from the group consisting essentially of acids, chelating agents, and combinations thereof, so that at least some of the deleterious metals (e.g. at least about 10%, preferably about 20%–80%) present in the material prior to treatment are removed from the material.

There may further be (d) removing at least some of the liquid from the slurry during (a) or (b) to purge at least some (e.g. at least about 10%, preferably about 20%–80%) of the metal containing compounds from the liquor circulations. This liquid may be removed in a liquor separating device, for example, a conventional Top Separator or In-line drainer, or the liquid may simply be removed via a branch conduit in the circulation line. Also (d) may also be practiced at substantially the same time as and using substantially the same equipment in which (b) is practiced. There may also further be (e) introducing liquid to the circulation to substantially replace the liquid removed in (d). The liquid introducing procedure (e) may be practiced substantially immediately downstream of where (d) is practiced or elsewhere in the system. Also (e) may be practiced substantially in conjunction with (c) so that replacement liquid is introduced substantially with the treatment chemical.

This invention is preferably practiced before a further procedure (f) of treating the material with an alkaline liquid and (g) digesting the material in an alkaline digestion process; preferably (a)–(e) are practiced substantially immediately prior to (f) and (g). The alkaline liquid may comprise, for example, kraft white, green, or black liquor (which may contain yield or strength enhancing additives as described above). Thus, in a preferred embodiment of the invention, the chemical used to effect (c) is introduced at or upstream of the first pump and the chemical used to effect (f) is introduced at or upstream of the second pump.

According to another aspect a method of treating comminuted cellulosic fibrous material is provided comprising the steps of: (a) Pumping a slurry of comminuted cellulosic fibrous material using the at least first and second series connected pumps. (b) Separating some liquid from the slurry at each station to substantially isolate liquor circulations and streams, and to recirculate removed liquid from at least one of the stations to upstream of one of the pumps. (c) Adding treatment chemical to the slurry upstream of at least one of the pumps so that pretreatment of the material occurs during transfer of the material from that pump to its associated station. And (d) circulating liquid removed form the second station to a location upstream of the first pump. Where at least first, second and third pumps and stations are provided, there is the further step (e) of circulating liquid removed from the third station to a location upstream of the second pump. The details of the steps, or additional steps, may be as set forth above.

According to one aspect of the invention there is provided a system for producing chemical cellulose pulp from comminuted fibrous cellulose material, comprising: A steaming vessel in which comminuted fibrous cellulose material is steamed to remove the air therefrom. A superatmospheric pressure vertical treatment vessel having an inlet for a slurry of comminuted cellulose fibrous material at a top portion thereof and an outlet at a bottom portion thereof. Pressurizing transfer means for pressurizing a slurry of material from the steaming vessel and transferring it to the treatment vessel inlet, the pressurizing transfer means consisting of one or more high pressure slurry pumps, each having an inlet and outlet, located below the top portion of the treatment vessel. And means for circulating liquid from the outlet of at least one the high pressure slurry pump to the inlet thereof.

The recirculation means may be conduits and associated connections to other components, although any conventional structures which allow or provide this recirculation may be utilized including valves (in or apart from the conduits), tanks, ejectors, pumps, ducts, heat exchangers, or the like.

The system preferably further comprises a liquid return line from the top portion of the treatment vessel, the return line operatively connected to an inlet or outlet of one of the slurry pumps.

The system may also comprise a heat exchanger located in the return line, which preferably is a liquid-to-liquid indirect heat exchanger. While the heat exchanger may be used for cooling or heating liquid in a return line preferably it is connected to a source of cool liquid and cools the liquid in the return line, so that it is below the point where it will flash in the system.

The system may further comprise a slurrying vessel having an inlet operatively connected to the steaming vessel and an outlet operatively connected to the inlet of the one or more slurry pumps; the system may still further comprise a liquid return line from the top portion of the treatment vessel, the return line operatively connected to the slurry vessel, and the heat exchanger in the return line.

Preferably the at least one pump comprises at least two pumps, and each of the pumps has a recirculation means as described above. The recirculation means may comprise a first valve in a recirculation conduit, and a second valve between the pump outlet and the treatment vessel, and preferably each of the pumps has a recirculation means as described above associated therewith.

The treatment vessel may be a first treatment vessel, and the system may further comprise a second treatment vessel. The main conduit is connected to the outlet of the pump (or the last in a series of pumps), and a flow splitter is provided having an inlet and at least two outlets. The main conduit is connected to the flow splitter inlet, and one of the flow splitter outlets is connected to the first treatment vessel, and another outlet to the second treatment vessel. The first treatment vessel may also include two or more inlets and the at least two or more outlets of the flow splitter may be connected to the two or more inlets of the first vessel. The flow splitter may comprise a chamber having a substantially triangular shaped static baffle plate arrangement with a triangle apex substantially aligned with the inlet.

According to another aspect of the invention there is provided a method of feeding cellulosic material to the top of a treatment vessel comprising the steps of: (a) Steaming the material to remove air therefrom and to heat the material. (b) Slurrying the material with a cooking liquor to produce a slurry of liquid and material. And (c) pressurizing the slurry at a location at least thirty feet below the top of the treatment vessel and transferring pressurized material to the top of the treatment vessel, the pressurizing step consisting of acting on the slurry with two or more high pressure slurry pumps.

The method may also comprise (d) establishing a recirculation loop between each pump outlet and inlet during startup. For example, there may be a first valve in the recirculation loop and a second valve between each pump outlet and the treatment vessel, in which case (d) is practiced to open the first valve and at least partially (e.g. completely) close the second valve during startup. Then the method may further comprise (e) after startup closing the first valve and opening the second valve. The method may also further comprise returning the liquid from the treatment vessel to one of the pump inlets (preferably a first in-series pump) and partially cooling the cooling liquid (e.g. with an indirect liquid-to-liquid heat exchanger) so that the returning liquid has a temperature below the point it will flash during handling.

The method may be practiced further utilizing at least a second treatment vessel or a first treatment vessel having two or more inlets, and may further comprise statically splitting the flow of slurry from the outlet of the last of the pumps to direct part of the flow to each treatment vessel or the inlets of the first treatment vessel.

According to another aspect of the present invention there is provided a method of feeding comminuted cellulosic fibrous material to the top of a treatment vessel, comprising: (a) Steaming the material to remove air therefrom and to heat the material. (b) Slurrying the material with a cooking liquor to produce a slurry of liquid and material; (c) Pressurizing the slurry at a location at least thirty feet below the top of the treatment vessel and transferring pressurized material to the top of the treatment vessel, said pressurizing step consisting of acting on the slurry with one or more high pressure slurry pumps. And (d) establishing a recirculation loop between the pump outlet and inlet during startup. A first valve may be provided in the recirculation loop and a second valve between the pump outlet and the treatment vessel; and (d) may be practiced to open the first valve and at least partially close the second valve during startup; and the method may further comprise (e) after startup closing the first valve and opening the second valve. Cooling and returning liquid, and flow splitting, may also be practiced, as described above.

According to another aspect of the present invention there is provided a static flow splitter comprising: A static chamber. An inlet and at least two outlets connected to the chamber. And a substantially triangular shaped static baffle plate arrangement may be located within the chamber and have a triangle apex substantially aligned with the inlet.

It is the primary object of the present invention to provide a simple and effective system and method for feeding cellulose slurry to a treatment vessel, and also while achieving enhanced operability and maintainability. This and other objects of the invention will become clear from an inspection of the detailed description of the invention and from the appended claims.

DETAILED DESCRIPTION OF THE DRAWINGS

Figure 1:
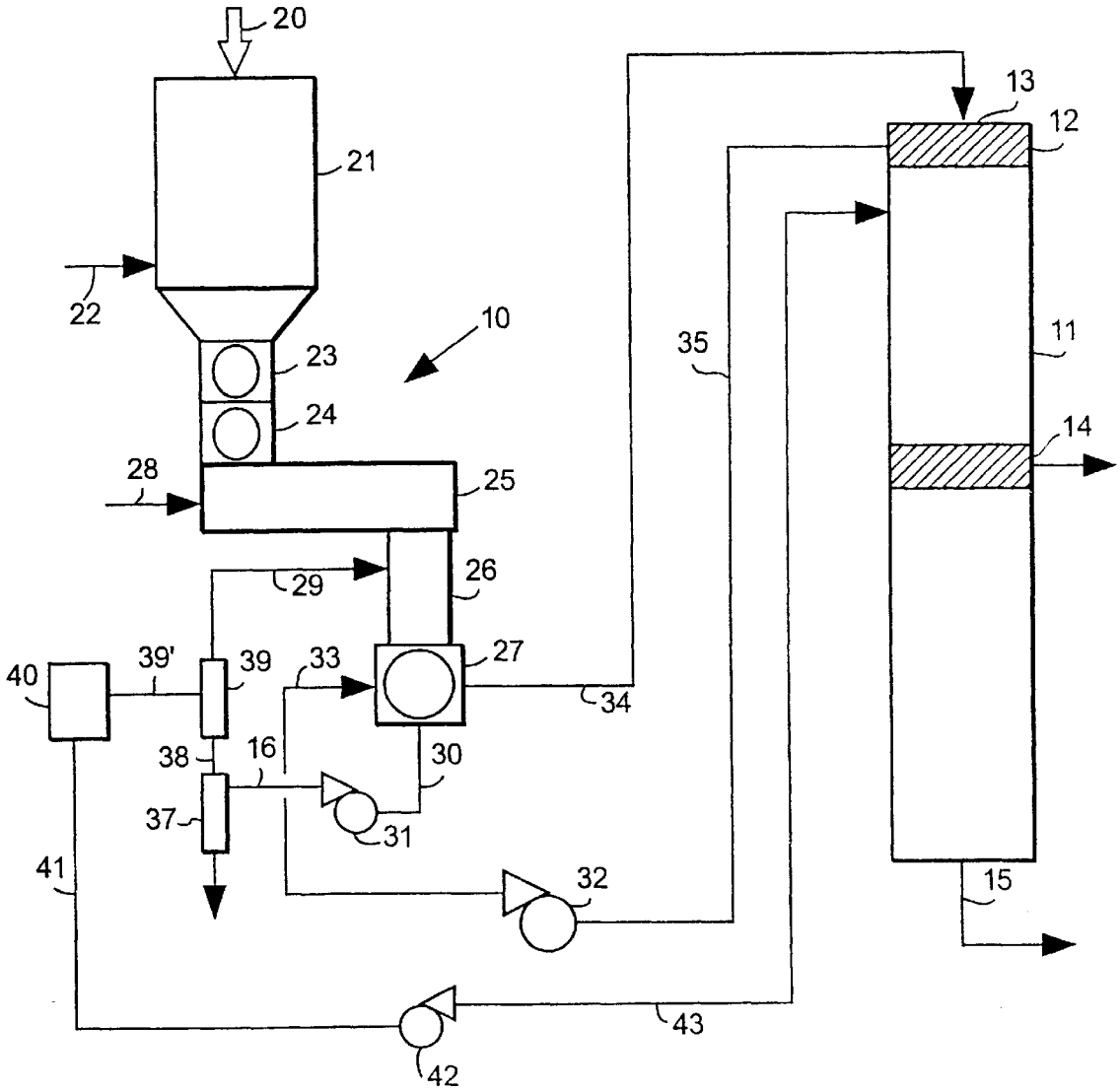
Fig. 1 (Prior Art)
FIG. 1 illustrates a typical prior art system for feeding a slurry of comminuted cellulosic fibrous material to a continuous digester.
Figure 2:
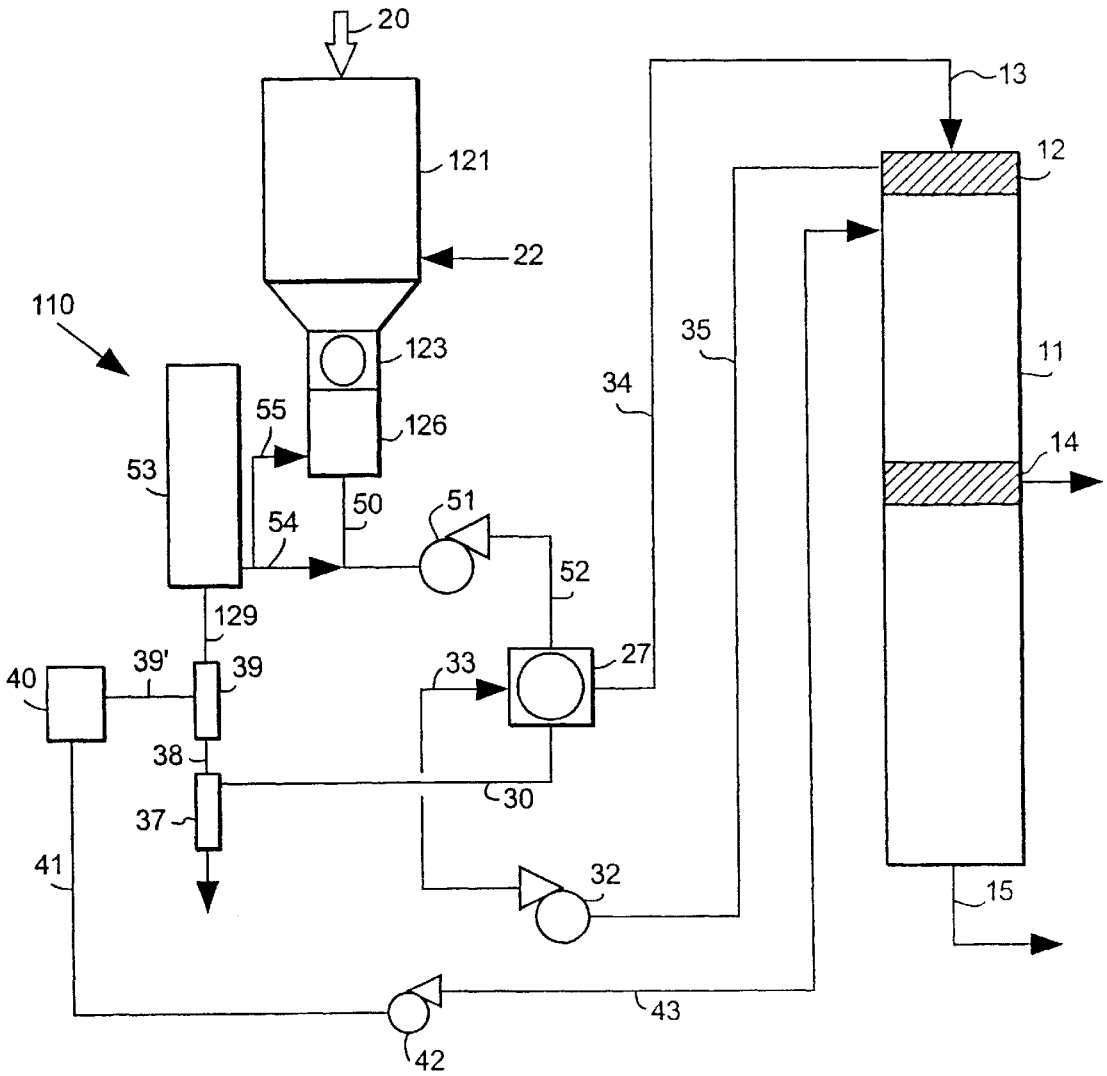
Fig. 2 (Prior Art)
FIG. 2 illustrates another prior at system for feeding a slurry of comminuted cellulosic fibrous material to a continuous digester.
Figure 3:
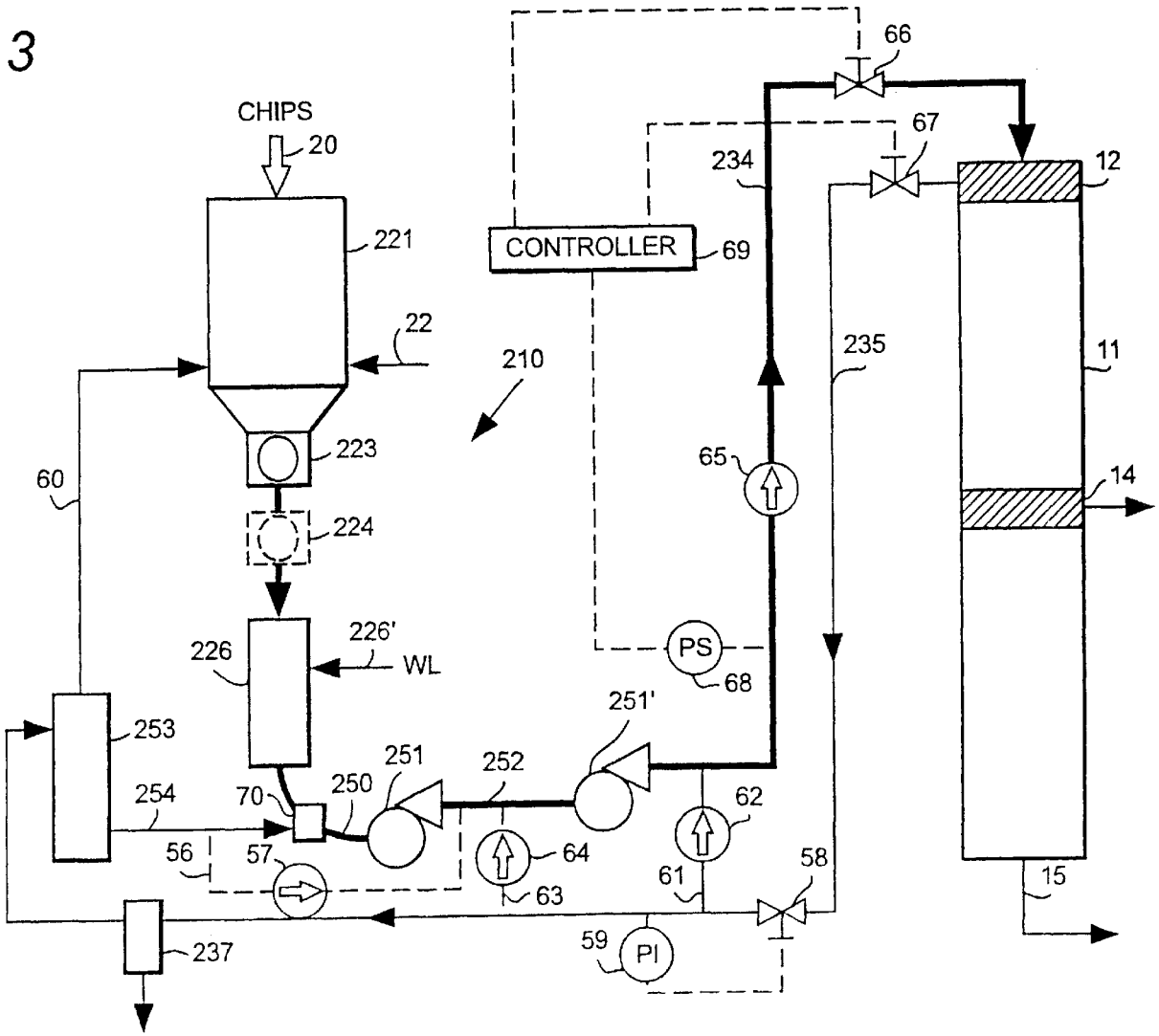
FIG. 3 illustrates one typical embodiment of a system for feeding a slurry of comminuted cellulosic fibrous material to a continuous digester according to this invention.

Though the systems shown and described in FIGS. 1–3 are continuous digester systems, it is understood that the method and system of the present invention can also be used to feed one or more batch digesters, or an impregnation vessel connected to a continuous digester. The continuous digesters shown and which may be used with this invention are preferably KAMYR® continuous digesters, and may be used for kraft (i.e., sulfate) pulping, sulfite pulping, soda pulping or equivalent processes. Specific cooking methods and equipment that may be utilized include the MCC®, EMCC®, and Lo-Solids® processes and digesters marketed by Ahlstrom Machinery Inc. Strength or yield retaining additives such as anthraquinone, polysulfide, or their equivalents or derivatives may also be used in the cooking methods utilizing the present invention.

FIG. 1 illustrates one typical prior art system 10 for feeding a slurry of comminuted cellulosic fibrous material, for example, softwood chips, to the top of a continuous digester 11. Digester 11 typically includes one liquor removal screen 12 at the inlet of the digester 13 for removing excess liquor form the slurry and returning it to feed system 10. Digester 11 also includes at least one liquor removal screen 14 for removing spent cooking liquor during or after the pulping process. Digester 11 also typically includes one or more additional liquor removal screens (not shown) which may be associated with cooking liquor circulation, such as an MCC®, EMCC® digester cooking circulation, or a Lo-Solids® digester circulation having a liquor removal conduit and a dilution liquor addition conduit. Cooking liquor, for example, kraft white, black, or green liquor, may be added to these circulations. Digester 11 also includes an outlet 15 for discharging the chemical pulp produced which may be passed on to further treatment such as washing or bleaching.

In the prior art feed system 10 shown in FIG. 1, comminuted cellulosic fibrous material 20 is introduced to chip bin 21. Typically, the material 20 is softwood or hardwood chips but any form of comminuted cellulosic fibrous material, such as sawdust, grasses, straw, bagasse, kenaf, or other forms of agricultural waste or a combination thereof, may be used. Though the term "chips" is used in the following discussion to refer to the comminuted cellulosic fibrous material, it is to be understood that the term is not limited to wood chips but refers to any form of the comminuted cellulosic fibrous materials listed above, or the like.

The chip bin 21 may be a conventional bin with vibratory discharge or a DIAMONDBACK® steaming vessel, as described in U.S. Pat. No. 5,500,083 and sold by Ahlstrom Machinery Inc., having no vibratory discharge but having an outlet exhibiting one-dimensional convergence and side relief. The bin 21 may include an airlock device at its inlet and a means for monitoring and controlling the level of chips in the bin and a vent with an appropriate mechanism for controlling the pressure within the bin. Steam, either fresh or steam produced from the evaporation of waste liquor (i.e., flashed steam), is typically added to bin 21 via one or more conduits 22.

The bin 21 typically discharges to a metering device, 23, for example a Chip Meter sold by Ahlstrom Machinery, but other forms of devices may be used, such as a screw-type metering device. The metering device 23 discharges to a pressure isolation device 24, such as a Low-Pressure Feeder sold by Ahlstrom Machinery. The pressure isolation device 24 isolates the pressurized horizontal treatment vessel 25 from the essentially atmospheric pressure that exists above device 24.

Vessel 25 is used to treat the material with pressurized steam, for example steam at approximately 10–20 psig. The vessel 25 may include a screw-type conveyor such as a Steaming Vessel sold by Ahlstrom Machinery. Clean or flashed steam is added to the vessel 25 via one or more conduits 28.

After treatment in vessel 25, the material is transferred to a high-pressure transfer device 27, such as a High-Pressure Feeder sold by Ahlstrom Machinery. Typically, the steamed material is transferred to the feeder 27 by means of a conduit or chute 26, such as a Chip Chute sold by Ahlstrom Machinery. Heated cooking liquor, for example, a combination of spent kraft black liquor and white liquor, is typically added to chute 26 via conduit 29 so that a slurry of material and liquor is produced in chute 26.

If the prior art system of FIG. 1 does employ a DIAMONDBACK® steaming vessel as disclosed in U.S. Pat. No. 5,000,083, which produces improved steaming under atmospheric conditions, the pressurized treatment vessel 25 and the pressure isolation device 24 may be omitted.

The conventional High-Pressure Feeder 27 contains a low pressure inlet connected to chute 26, a low pressure outlet connected to conduit 30, a high-pressure inlet connected to conduit 33, a high-pressure outlet connected to conduit 34, and a pocketed rotor driven by a variable-speed electric motor and speed reducer (not shown). The low pressure inlet accepts the heated slurry of chips from chute 26 into a pocket of the rotor. A screen in the outlet, at 30, of the feeder 27 retains the chips in the rotor but allows the liquor in the slurry to pass through the rotor to be removed via conduit 30 and pump 31. As the rotor turns the chips that are retained within the rotor are exposed to high pressure liquid from pump 32 via conduit 33. This high-pressure liquor slurries the chips out of the feeder and passes them to the top of digester 11 via conduit 34. Upon reaching the inlet of digester 11 some of the excess liquor used to slurry the chips in conduit 34 is removed from the slurry via screen 12. The excess liquor removed via screen 12 is returned to the inlet of pump 32 via conduit 35. The liquor in conduit 35, to which fresh cooking liquor may be added, is pressurized in pump 32 and passed in conduit 33 for use in slurrying the chips out of feeder 27. The chips that are retained by the screen 12 pass downwardly in the digester 11 for further treatment.

The liquor removed from feeder 27 via conduit 30 and pump 31 is recirculated to the chute 26 above the feeder 27 via conduit 36, sand separator 37, conduit 38, in-line drainer 39 and conduit 29. Sand separator 37 is a cyclone-type separator for removing sand and debris from the liquor. In-line drainer 39 is a static screening device which removes excess liquor from conduit 38 and passes it through conduit 39' and stores it in level tank 40. Liquor stored in tank 40 is returned to the top of the digester via conduit 41, pump 42 (i.e., the Make-up Liquor Pump), and conduit 43. Fresh cooking liquor may also be added to conduits 41 or 43.

FIG. 2 illustrates another prior art system 110 for feeding chips to a digester. This system uses processes and equipment described in U.S. Pat. Nos. 5,476,572, 5,622,598 and 5,635,025. This equipment and the processes they are used to effect are collectively marketed under the trademark Lo-Level™ by Ahlstrom Machinery. The components in FIG. 2 which are identical to those that appear in FIG. 1 are identified by the same reference numbers. Those components which are similar or which perform similar functions to those that appear in FIG. 1 have their reference numbers that appear in FIG. 1 prefaced by the numeral "1".

Similar to the system of FIG. 1, chips 20 are introduced to steaming vessel 121 where they are exposed to steam introduced via conduit 22. The vessel 121 discharges to metering device 123, and then to conduit 126, which is preferably a Chip Tube as sold by Ahlstrom Machinery. Cooking liquor is typically introduced to tube 126 via conduit 55, similar to conduit 29 of FIG. 1. Since the vessel 121 is preferably a DIAMONDBACK® steaming vessel as described in U.S. Pat. No. 5,000,083, no pressure isolation device, 24 in FIG. 1, or pressurized steaming vessel 25 in FIG. 1, are needed in this prior art system. As disclosed in U.S. Pat. No. 5,476,572 instead of discharging the slurry of chips and liquor directly to feeder 27, a high-pressure slurry pump 51 fed by conduit 50 is used to transport the chips to the feeder 27 via conduit 52. The pump 51 is preferably a Hidrostal pump as supplied by Wemco, or similar pump supplied by the Lawrence company. The chips that are passed via pump 51 are transported to digester 11 by feeder 27 in a manner similar to what was shown and described with respect to FIG. 1.

In addition to using the pump 51 to pass the slurry to the feeder 27, the system of FIG. 2 does not require the pump 31 of FIG. 1. Pump 51 supplies the motive force for passing liquor through the feeder 27, through conduit 30, sand separator 37, in-line drainer 39, and conduit 129 to liquor level tank 53.

The function of level tank 53 is disclosed in pending application Ser. No. 08/428,302, filed on Apr. 25, 1995. The tank 53 ensures a sufficient supply of liquor to the inlet of the pump 51, via conduit 54. This tank may also supply liquor to tube 126 via conduit 55. This liquor tank 53 also allows the operator to vary the liquor level in the feed system such that, if desired, the liquor level may be elevated to the metering device 123 or even to the bin 121. This option is also described in pending application Ser. No. 08/354,005, filed on Dec. 5, 1994.

FIG. 3 illustrates one preferred embodiment of a feed system 210 that simplifies even further the prior art feeding systems shown in FIGS. 1 and 2. In the preferred embodiment shown in FIG. 3, the high-pressure transfer device, component 27 of FIGS. 1 and 2, has been eliminated. Instead of transferring chips to the feeder 27 by means of gravity in chute 26 of FIG. 1 or via pump 51 in FIG. 2, at least one, preferably two, high-pressure slurry pumps 251, 251' are used to transport the slurry to the inlet of the digester 11. The components in FIG. 3 which are essentially identical to those that appear in FIGS. 1 and 2 are identified by the same reference numbers. Those components which are similar or which perform similar functions to those that appear in FIGS. 1 and 2 have their reference numbers that appear in FIGS. 1 and 2 prefaced by the numeral "2".

Similar to the procedure in FIGS. 1 and 2, according to the embodiment of FIG. 3, chips 20 are introduced to steaming vessel 221. The chips are preferably introduced by means of a sealed horizontal conveyor as disclosed in pending application Ser. No. 08/713,431, filed on Sep. 13, 1996. Also, the steaming vessel 221 is preferably a DIAMONDBACK® steaming vessel as described in U.S. Pat. No. 5,000,083 to which steam is added via one or more conduits 22. The steaming vessel 221 typically includes conventional level monitoring and controls as well as a pressure-relief device (not shown). Vessel 221 discharges steamed chips to metering device 223, which, as described above, may be a pocketed rotor-type device such as a Chip Meter or a screw-type device.

In one embodiment the metering device 223 discharges directly to conduit or chute 226. However, in an optional embodiment, a pressure isolating device, such as a pocketed rotor-type isolation device, shown in dotted line at 224, for example a conventional Low-pressure Feeder, may be located between metering device 223 and chute 226. Though without the pressure-isolation device 224 the pressure in chute 226 is essentially atmospheric, with a pressure isolation device 224 the pressure in chute 226 may range from 1 to 50 psig, but is preferably between 5 to 25 psig, and most preferably between about 10 to 20 psig. Cooking liquor, as described above, is added to chute 226 (see line 226' in FIG. 3) so that a slurry of chips and liquor is produced in chute 226 having a detectable level (not shown). The slurry in chute 226 is discharged via radiused outlet 250 to the inlet of pump 251. The introduction of slurry to the inlet of pump 251 is typically augmented by liquor flow from liquor tank 253 via conduit 254 as described in pending application Ser. No. 08/428,302.

Pump 251 is preferably a centrifugal high-pressure, helical screw, slurry pump, such as a "Hidrostal" pump supplied by Wemco of Salt Lake City, Utah. The pump 251 may alternatively be a slurry pump supplied by the Lawrence Company of Lawrence, Mass. The pressure at the inlet to pump 251 may vary from atmospheric to 50 psig depending upon whether a pressure isolation device 224 is used.

In the preferred embodiment illustrated in FIG. 3, the outlet of pump 251 discharges to the inlet of pump 251'. Pump 251' is preferably the same type of pump as pump 251 but with the same or a higher pressure rating. If two pumps are used, the pressure produced in the outlet of pump 251' typically ranges from 150 to 400 psig (i.e., 345–920 feet of water, gauge), but is preferably between about 200 and 300 psig (i.e., 460–690 feet). If necessary, the liquor in the slurry in conduit 252 may be augmented by liquor from tank 253 via conduit 56 and liquid pump 57.

Though the embodiment illustrated in FIG. 3 includes two pumps, only one pump, or even three or more pumps, in series or parallel, may alternatively be used. In these cases, the discharge pressure from the one pump, or from the last pump, is preferably the same as the discharge pressure from pump 251' above.

The pressurized, typically heated, slurry is discharged from pump 251' to conduit 234. Conduit 234 passes the slurry to the inlet of continuous digester 11. Excess liquor in the slurry is removed via screen 12 as is conventional. The excess liquor is returned to the feed system 210 via conduit 235, preferably to liquor tank 253 for use in slurrying in conduit 250 via conduit 254. The liquor in conduit 235 may be passed through a sand separator 237 if desired. This sand separator 237 may be designed for pressurized or unpressurized operation depending upon the mode of operation desired.

Unlike the prior art systems employing a High-Pressure Feeder (27 in FIGS. 1 and 2) which uses the pressure of the liquor returned via conduit 35 as an integral part of the method of slurrying from the High-Pressure Feeder to the digester 11, it is not essential for the operation of the present invention that the pressurized recirculation 235 be returned to the inlet of the pumps 251, 251'. The energy available in the pressure of the flow in line 235 may be used wherever necessary in the pulp mill. However, in a preferred embodiment, the present invention does utilize the pressure available in conduit 235 to minimize the energy requirements of pumps 251 and 251' as much as possible.

How the pressure in return line 235, typically about 150 to 400 psig is used depends upon the mode of operation of the feed system 210. If vessel 226 is operated in an unpressurized—essentially atmospheric—mode, the pressurized liquor returned in conduit 235 must be returned to essentially atmospheric pressure before being introduced to conduit 250. One means of doing this is to use a pressure control valve 58 and a pressure indicator 59 in conduit 235. The opening in valve 58 is controlled such that a predetermined reduced pressure exists in line 235 downstream of valve 58. In addition, the liquor tank 253 may be designed so that it acts as a "flash tank" so that the hot pressurized liquor in conduit 235 is rapidly evaporated to produce a source of steam in vessel 253. This steam can be used, among other places, in vessel 221 via conduit 60. However, instead, in a preferred embodiment, the pressurized liquor in conduit 235 is used to augment the flow out of pump 251', for example via conduit 61 and pump 62. The pressure in conduit 235 may also be used to augment the flow between pumps 251 and 251' in conduit 252 via conduit 63, with or without pump 64 (a check valve may in some cases be used in place of or in addition to each of pumps 62, 64). By re-using some of the pressure available in line 235, some of the energy requirements of pumps 251 and 251' may be reduced.

Also, the heat of the liquor in line 235 can also be passed in heat-exchange-relationship with one or more other liquids in the pulp mill that need to be heated.

The pressurizing and transferring of pumps 251 and 251' may instead by effected by a conventional eductor, for example, an eductor manufactured by Fox Valve Development Corporation. Or pumps 251, 251' may be used in conjunction with an eductor for increasing the pressure in the inlet or outlet of the pumps. An eductor may also be used as a means of introducing liquid to the chips. For example, an eductor may be located in the outlet of or beneath vessel 226 and liquid first introduced to the chips by means of this eductor. The eductor may comprise a venturi-type orifice in one or more conduits 250, 252, and 234 into which a pressurized stream of liquid is introduced. This pressurized liquid may be obtained from any available source but is preferably obtained from conduit 235, upstream of valve 58. An exemplary eductor is shown schematically at 70 in FIG. 3.

The pumps 251 and 251' need not be centrifugal pumps but may be any other form of slurry transfer device that can directly act on to pressurize and transfer a slurry of chips and liquor from the outlet of vessel 226 to the inlet of digester 11. For instance, a solids pump as typically used in the mining industry may be used; for example, a double-piston solids pump such as the KOS solids pump sold by Putzmeister, or any other similar conventional pumping device may be used.

One function of the prior High-Pressure Feeder 27 of FIGS. 1 and 2 is to act as a shut-off valve to prevent possible escape of the pressure in the equipment and transfer conduits, for example, conduits 34 and 35 of FIG. 1, should any of the feed components malfunction or fail. In the feed system 210 according to the present invention, alternative means are provided to prevent such release of pressure due to malfunction or failure. For example, FIG. 3 illustrates a one-way (check) valve 65 in conduit 234 to prevent pressurized flow from returning to pump 251 or 251'. In addition, conventional automatic (e.g. solenoid operated) isolation valves 66 and 67 are located in conduits 234 and 235, respectively, to isolate the pressurized conduits 234, 235 from the rest of the feed system 210. In one preferred mode of operation, a conventional pressure switch 68 is located downstream of pump 251' in conduit 234. The switch 68 is used to monitor the pressure in line 234 so that should the pressure deviate from a predetermined value, the conventional controller 69 will automatically isolate digester 11 from feed system 210 by automatically closing valves 66 and 67. These valves may also be automatically closed when a flow direction sensor detects a reversal of flow in conduit 234.

While the pressure release preventing means 65–69 described above is preferred, other arrangements of valves, sensors, indicators, alarms, or the like may comprise the pressure release preventing means as long as such arrangements adequately perform the function of preventing significant depressurization of the digester 11.

While the system 210 is preferably used with a continuous digester 11, it also may be used with other vertical superatmospheric (typically a pressure of at least about 10 bar gauge) treatment vessels having a top inlet, such as an impregnation vessel or a batch digester.

Figure 4:
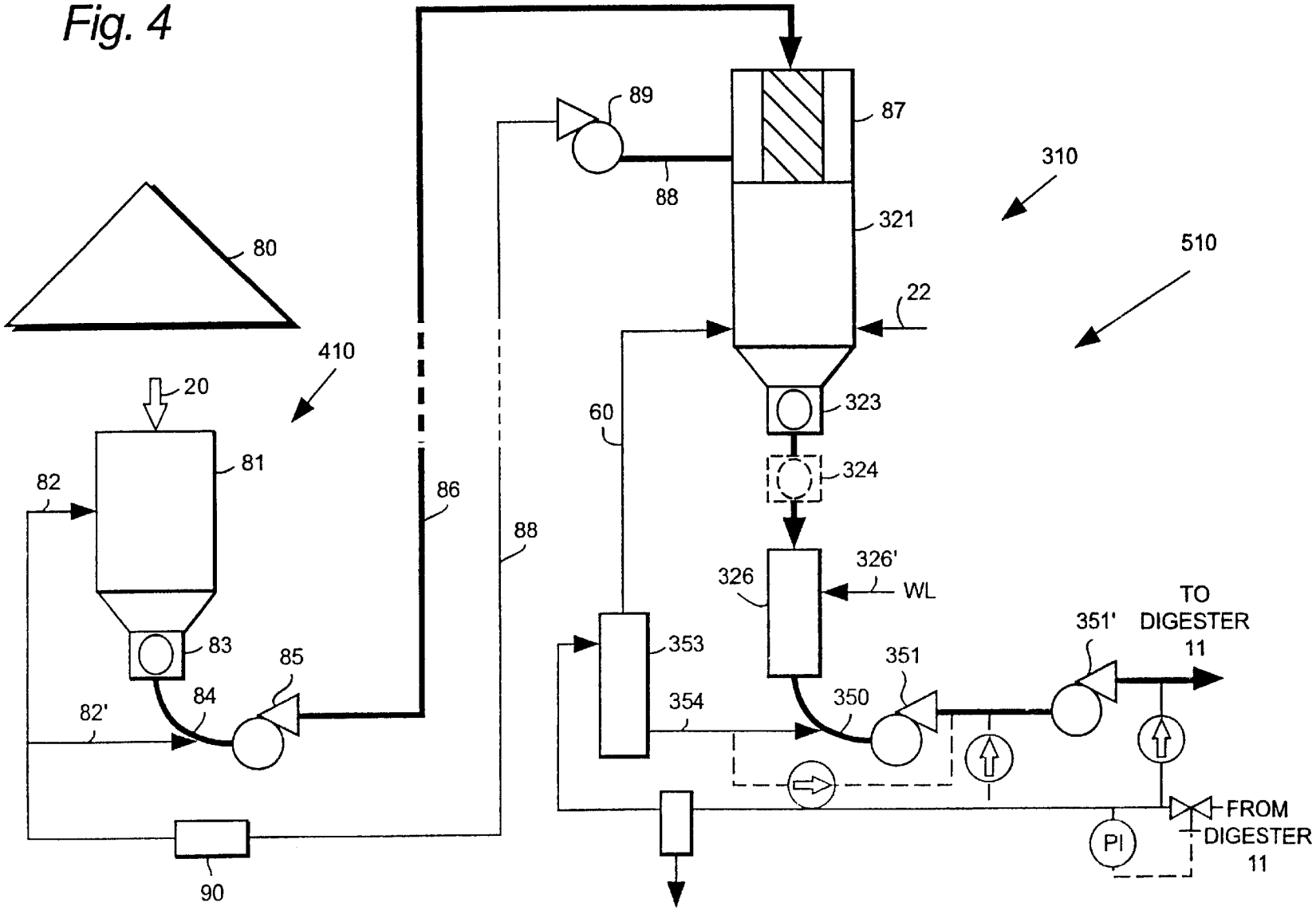
FIGS. 4 and 5 illustrate two other embodiments of systems according to the invention.

FIG. 4 illustrates a further embodiment in which the concept of transferring chips is extended from the feed system of a digester to the Woodyard of a pulp mill. FIG. 4 illustrates a system 510 for feeding comminuted cellulosic fibrous material to a pulping process. It consists of a subsystem 410 for introducing chips from the Woodyard to system 510 and a subsystem 310 for treating and feeding chips to digester 11. Subsystem 310 is essentially identical to the system 210 shown in FIG. 3.

Again, the components in FIG. 4 which are identical to those that appear in FIGS. 1–3 are identified by the same reference numbers. Those components which are similar or which perform similar functions to those that appear in FIG. 1–3 have their reference numbers that appear in FIG. 1 prefaced by the numeral "3".

The Woodyards of conventional pulp mills receive their wood supply in various forms as described above. Typically, the wood, or other comminuted cellulosic fibrous material, is converted to chip like form and stored either in open chip piles or in chip storage silos. In FIG. 4 the chip supply is shown as chip pile 80. In a preferred embodiment of this invention the chips from pile 80 or some other storage vessel are conveyed by conventional means, e.g., a conveyor or front-end loader (not shown), and introduced 20 to vessel 81. This vessel may be a DIAMONDBACK® vessel or any other conventional storage vessel. Vessel 81 may be operated at superatmospheric pressure, for example at 0.1 to 5 bar. If the vessel is operated at superatmospheric pressure, some form of pressure isolation device (not shown) may be located at the inlet of the vessel to prevent the release of pressure. This device may be a star-type isolation device, such as a Low-pressure Feeder or Air-lock Feeder as sold by Ahlstrom Machinery, or a screw-type feeder having a sealing capacity as described in co-pending application Ser. No. 08/713,431.

Liquid, for example fresh water, steam, liquids containing cooking chemicals is introduced to vessel 81 via one or more conduits 82 to produce a slurry of liquid and chips and to provide a detectable liquid level in vessel 81. Means for monitoring and controlling the level of the liquid, and the level of the chips, in vessel 81 may be provided. This liquid may be a heated liquid, for example, hot water or steam, having a temperature of between 50 and 100° C. If the vessel is a pressurized vessel, liquid temperatures of over 100° C. may be used. Preferably, though not essentially, this liquid may contain at least some active pulping chemical, for example, sodium hydroxide (NaOH), sodium sulfide (Na2S), polysulfide, anthraquinone or their equivalents or derivatives or surfactants, enzymes or chelants, or combinations thereof.

From vessel 81, the slurry is discharged to the inlet of slurry pump 85 via conduit 84. The discharge from vessel 81 may be aided by a discharge device 83 (probably not necessary if a DIAMONDBACK® discharge is used). The flow of slurry in conduit 84 may also be aided by the addition of liquid via conduit 82'. The conduit 82' may be the only mechanism for introducing liquid, so that a liquid level is present in conduit 84 or not in vessel 81. Pump 85 may be any type of slurry pump discussed above, for example, a Wemco or Lawrence pump or their equivalents, any other type of solids or slurry transfer device. Though only one pump 85 is shown, more than one pump or similar devices may be used to transfer the slurry via conduit 86 to vessel 321. The slurry transfer via conduit 86 may include one or more storage or surge tanks (not shown). Preferably, the one or more pumps 85 include at least one device having de-gassing capability so that undesirable air or other gases may be removed from the slurry.

The slurry discharged from pump 85 is transferred via conduit 86 to subsystem 810. Subsystem 810 may be located adjacent subsystem 710, that is, within about 30 feet of subsystem 710, or may be spaced an appreciable distance from subsystem 710, for example one-half mile or more away, depending upon the layout of the pulp mill. Hence, conduit 86 is broken to indicate an undetermined distance between subsystem 710 and subsystem 810.

The pressure in conduit 86 is dependent upon the number of pumps and other transfer devices used and the height and distance that the slurry must be transferred. The pressure in conduit 86 may vary from about 5 psig to over 500 psig.

Also, during transfer, the chips may be exposed to some form of treatment, for example, de-aeration or impregnation with a liquid, preferably a liquid containing pulping chemicals, such as those described above. The slurry may also be exposed to at least one pressure fluctuation during transfer, such that the pressure of the slurry is varied from a first pressure to a second, higher pressure, and then to a third pressure which is lower than the second pressure. As described in U.S. Pat. Nos. 4,057,461 and 4,743,338 varying the pressure of a slurry of chips and liquor improves the impregnation of the chips with the liquor. This pressure pulsation may be achieved via varying the outlet pressure of a set of transfer devices in series, or by controlled depressurization of the slurry between pumping.

The slurry in conduit 86 is introduced to the inlet of vessel 321. Though the vessel shown is a treatment, i.e., steaming, vessel, it may also be a storage vessel, an impregnation vessel, or even a digester. Since the transfer in conduit 86 typically requires that at least some excess liquid, that is not needed during treatment or storage, some form of de-watering device 87 may be located between the transfer device and the treatment vessel. One preferred dewatering device is a Top Separator, as sold by Ahlstrom Machinery. This Top Separator may be a standard type or an "inverted" Top Separator. This device may be an external stand-alone-type unit or one that is mounted directly onto the treatment vessel, as shown. Preferably, the liquid removed from the slurry by means of de-watering device 87 is returned to vessel 82 or to the inlet of the pump, or pumps, 85 via conduit 88 to aid in slurrying the chips. This liquid removed via device 87 may also be used where ever needed in the pulp mill. This liquid in conduit 88 may be heated or cooled as desired in a heat exchanger 90 and may be pressurized using one or more conventional centrifugal liquid pumps, 89. The liquid in conduit 88 may be introduced to vessel 81 via conduit 82 and to conduit 84 via conduit 82'.

The treatment vessel 321 shown is a steaming vessel similar to vessel 221 shown in FIG. 3, for example a DIAMONDBACK® steaming vessel. The feed system 310 is otherwise similar to the system 210 shown in FIG. 3. For example, chip feeding system 410, feeds digester feed system 310, which feeds digester 11. Note that system 310 of FIG. 4 is simply one subsystem in the over-all system which feeds chips from the chip pile 80 to the digester 11. This system may include one or more subsystems 310 for feeding to digester 11.

Figure 5:
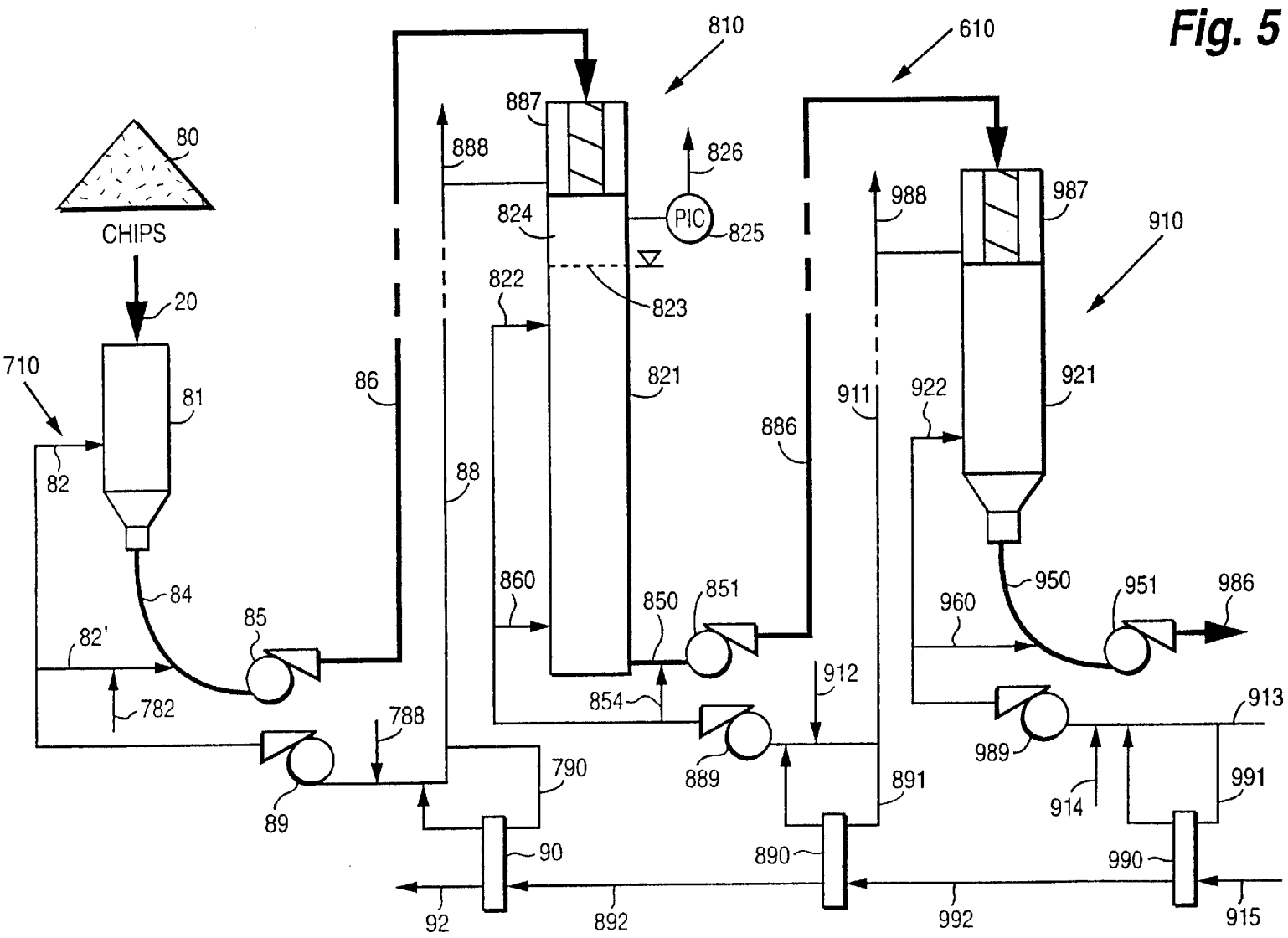

FIG. 5 illustrates a further embodiment 610 that is an extension of the system 510 shown in FIG. 4. The system 610 is a combination of three subsystems 710, 810 and 910. Subsystem 710 is similar to the system 410 of FIG. 4. Items in FIG. 5 that are essentially identical to those found in FIGS. 1 through 4 are identified by the same numbers.

Wood chips 20, or some other comminuted cellulosic fibrous material, from chip pile 80 are introduced with or without pressure isolation to vessel 81. The chips in vessel 81 may be treated with a gas, such as steam or hydrogen sulfide, or a liquid, such as water or a liquid containing cooking chemical, introduced by way of one or more conduits 82. Vessel 81 may be any type of vessel, but is preferably a DIAMONDBACK® bin, as described above. The treated chips are discharged from vessel 81 into conduit 84. Though any type of discharging mechanism can be used, the discharge of chips from vessel 81 is preferably performed without the aid of mechanical agitation or vibration, as is characteristic of DIAMONDBACK® chips bins. Conduit 84 may be any type of pipe or chute but is preferably a curved Chip Tube as described above.

Conduit 84 introduces the chips to the inlet of slurry pump 85, which may be of the type supplied by Wemco or Lawrence, as described above. Typically, slurrying liquid is preferably first introduced to the chips in conduit 84, for example, using the conduit 82', to produce a level of liquid in vessel 81 or conduit 84. The liquid introduced via conduit 82', may be water or a liquid containing treatment chemicals such as kraft liquors, with or without strength or yield enhancing additives. Make-up liquor, for example, liquor containing these chemicals, is typically added via conduit 782.

The slurry in conduit 86 is introduced to subsystem 810 via liquor separating device 887, which is similar in operation to device 87 shown in FIG. 4. The liquid removed via separator 887 can be returned to subsystem 710 via conduit 88 or can be used elsewhere in the pulp mill via conduit 888. If returned to subsystem 710 via conduit 88 the liquor may be augmented with additional liquid or chemical via conduit 788, heated via indirect heat exchanger 90 via conduit 790 and pressurized by pump 89 prior to being re-introduced to vessel 81 via conduit 82 or to conduit 84 via conduit 82'. Subsystem 710 may also include a liquor storage tank similar to tank 353 shown in FIG. 4. Thus by the use of heater 90 and chemical addition 782 or 788, the slurry of material transferred from subsystem 710 to subsystem 810 via conduit 86 may be heated to any desirable temperature while being treated with chemicals. For example, if the slurry in conduit 86 is heated to about 90° C. or above in the presence of alkali or sulfide, some pretreatment of the will occur during the retention time in conduit 86 prior to introduction of the slurry into subsystem 810. Of course, lower temperatures and other chemicals may also be used in conduit 86.

The chips retained by separator 887 are passed to vessel 821. Vessel 821 may be a vessel similar to vessel 81, but is preferably a tall cylindrical vessel, for example, 20 to 50 feet tall, in which a liquid level 823 is maintained. A gas space 824 may be maintained above level 823. Vessel 821 may be maintained at atmospheric pressure or at super-atmospheric pressure, for example, at 0.2 to 10 bar gauge pressure (e.g. about 5 bar), depending on the treatment performed in vessel 821. The temperature in vessel 821 may vary from 50 to 300° C., but is typically between about 50 and 150° C. Liquid may be introduced to vessel 821 via one or more conduits 822 or 860. This liquid may contain cooking chemicals or additives as discussed above. These cooking chemicals or additives may be the same as those introduced in subsystem 710 or they may be different. For example, kraft cooking liquor containing a high concentration of sulfide ion or sulfidity may be introduced to subsystem 710 and kraft cooking chemical containing a lower concentration of sulfide ion or sulfidity may be introduce to the chips in subsystem 810. In another example, a polysulfide-type additive may be introduced to the chips in subsystem 710 and an anthraquinone-type additive may be introduced in subsystem 810.

The pressure within the vessel 821 may be monitored and controlled via pressure indicator and controller 825. Excess pressure may be released via conduit 826, for example, to a conventional noncondensable gas (NCG) treatment system or to vessel 81 for pretreatment. In addition, the pressure controller 825 can be used to regulate the pressure in vessel 821 to vary the pressure to effect pressure pulsation impregnation as described in U.S. Pat. Nos. 4,057,461 and 4,743,338.

The slurry is discharged from vessel 821 to conduit 850. This discharge may be effected without agitation or vibration as in a DIAMONDBACK® chip bin, or it may be effected by agitation or vibration as is conventional. Conduit 850 introduces the slurry to the inlet of pump 851, which may be similar to pump 85, but typically will have a higher pressure rating. Additional liquid may be introduced to conduit 850 via conduit 854 to aid in introducing the slurry to the pump 851. The slurry discharged from pump 851 is passed to subsystem 910 via conduit 886.

The slurry in conduit 886 is introduced to subsystem 910 using the liquor separating device 987. The separator 987 is similar to devices 887 and 87 (of FIG. 4). The liquor removed from device 987 may be returned by conduit 911 to subsystem 810 or may be used elsewhere in the pulp mill via conduit 988. If returned to subsystem 810 via conduit 911, the liquor may be augmented with additional liquid or chemical via conduit 912, heated via indirect heat exchanger 890 via conduit 891 and pressurized by pump 889 prior to being re-introduced to vessel 821 via conduit 822 or 860 to conduit 850 via conduit 854. The liquor in conduit 911 may also be introduced to subsystem 710, for example, via a common connection with conduit 88 or 82. Subsystem 810 may also include a liquor storage tank similar to tank 353 shown in FIG. 4. Thus by using heater 890 and chemical addition 912, the slurry of material transferred from subsystem 810 to subsystem 910 via conduit 886 may be heated to any desirable temperature while being treated with chemicals. For example, if the slurry in conduit 886 is heated to about 90° C. or above in the presence of alkali or sulfide, some pretreatment of the material will occur during the retention time in conduit 886 prior to introduction of the slurry into subsystem 910. Of course, lower temperatures and other chemicals may also be used in conduit 886.

The chips retained by separator 987 are passed to vessel 921, which may be a vessel similar to vessels 81, or a tall vessel similar to vessel 821, or a vessel similar to vessel 321 of FIG. 4. Vessel 921 may be maintained at atmospheric pressure, or at super-atmospheric pressure [for example, at 0.2 to 10 bar gauge, preferably 0.5 to 5 bar gauge pressure] depending on the treatment performed in vessel 921. The temperature in vessel 921 may vary from 50 to 300° C., but is typically between about 50 and 150° C., preferably between about 80 and 120° C. Liquid may be introduced to vessel 921 via one or more conduits 922 or 960. The introduced liquid may contain cooking chemicals or additives as discussed above. These cooking chemicals or additives may be the same as those introduced in subsystem 710 or 810 or they may be different. For example, kraft cooking liquor containing a high concentration of sulfide ion or sulfidity may be introduced to subsystem 810 and kraft cooking chemical containing a lower concentration of sulfide ion or sulfidity may be introduced to the chips in subsystem 910. In another example, a polysulfide-type additive may be introduced to the chips in subsystem 710 and an anthraquinone-type additive may be introduced in subsystem 810, and kraft white liquor may be introduced to the chips in subsystem 910. Each or these liquors can be isolated from each other by the liquor separators 887 and 987.

The slurry is discharged from vessel 921 to conduit 950. This discharge may be effected without agitation or vibration using a discharge as in a DIAMONDBACK® chips bin, or it may be aided by agitation or vibration as is conventional. Conduit 950 introduces the slurry to the inlet of pump 951, which may be similar to pumps 85 and 851, but typically will have a higher pressure rating. Additional liquid may be introduced to conduit 950 via conduit 960 to aid in introducing the slurry to the pump 951. The slurry discharged from pump 951 is passed to further treatment via conduit 986, for example, to a digester (that is, a continuous or batch digester), or to further treatment in a subsystem similar to subsystems 810 or 910, or subsystem 310 of FIG. 4. However, the treatment effected in subsystems 710, 810 and 910 may be sufficient to produce an essentially fully-cooked pulp slurry in conduit 950 such that no further "pulping" need be performed. The pulp in conduit 950 may be passed directly to washing and/or bleaching.

As in subsystems 310, 810, and 910, excess liquor may be returned to subsystem 910 via conduit 913. The liquor may be augmented with additional liquid or chemical via conduit 914, heated via indirect heat exchanger 990 via conduit 991 and pressurized by pump 989 prior to being re-introduced to vessel 921 via conduit 922 or to conduit 950 via conduit 960. The liquor in conduit 913 may also be introduced to subsystem 710 or 810, for example, via a common connection with conduit 88 or 82 (not shown) or a common connection with conduits 911 or 822, or similar conduits. Subsystem 910 may also include a liquor storage tank similar to tank 353 shown in FIG. 4.

Thus, using heater 990 and chemical addition 914, the slurry of material transferred from subsystem 910 to the subsequent subsystem or digester via conduit 986 may be heated to any desirable temperature while being treated with chemicals. For example, if the slurry in conduit 986 is heated to about 90° C. or above in the presence of alkali or sulfide, some pretreatment of the chips will occur during the retention time in conduit 986 prior to introduction of the slurry into the subsequent treatment device, for example to digester 11 of FIGS. 1 and 2. Of course, lower or higher temperatures and other chemicals may also be used in conduit 986.

Also, though indirect heat exchangers 90, 890, and 990 may each be supplied by their own separate source of heat, for example, separate sources of steam or hot water or hot effluent that would normally be discharged, heat exchangers 90, 890 and 990 may also be supplied with a common source of heat 915. The source of heat 915 may be, for example, hot effluent or steam (low, medium or high pressure steam), and may be introduced to heat exchanger 990 and the residual heat transferred to heat exchanger 890 via conduit 992. The residual heat from heat exchanger 890 may be passed to heat exchanger 90 via conduit 892. Any residual heat remaining in conduit 92 may be used as needed in systems 710, 810 or 910 or elsewhere in the mill, or it may be discarded. For example, the liquid in conduit 92, and any residual heat it may contain, may be introduced to vessel 81 or 821 via conduits 82 or 822 to recover and re-use as much of the available energy as possible.

Using a system 610 as shown in FIG. 5, a counter-current flow of treatment liquids can be established between each subsystem. For example, the liquid from upstream treatment can be returned to subsystem 910 via conduit 913; the liquid from subsystem 910 can be returned to subsystem 810 via conduit 911; and the liquid from subsystem 810 can be returned to subsystem 710 via conduit 88. In addition some or all of these liquors can be removed and used elsewhere via conduits 888 and 988.

The chemical addition at 788, 912, and 914 is preferably sodium hydroxide, sodium sulfide; polysulfide, anthraquinone or their equivalents or derivatives; surfactants, enzymes, or chelants; or combinations thereof. For example, different treatment chemicals could be added at each of 788, 912, and 914, so that different treatments take place in each of the sections 710, 810, and 910. For example, polysulfide may be added at 788, anthraquinone at 912, and chelants and enzymes at 914. The conduits at 788, 912, 914 need not be provided where illustrated in FIG. 5, but may be provided at any convenient location which facilitates impregnation, or other pretreatment, simultaneously with transport. For example, lines 788, 912, 914 may be added to the lines 790, 891, 991 before the heater exchangers 90, 890, 990, respectively.

In one preferred embodiment, the slurry is treated in the system of FIG. 5 to remove undesirable metal-containing compounds or metal ions from the cellulose material. For example, in this embodiment the chemical added to the slurry is an acid and/or chelating agent. The acid is preferably sulfuric acid, sulfur dioxide, acetic acid, formic acid, oxalic acid, peroxy acids, Caro's acid, or their equivalents, or combinations thereof. Acidic bleach plant filtrates can also be used as the source of acid. The pH of the liquid during acid treatment typically varies from a pH of about 1 to a pH of about 7, but is preferably between a pH of about 2 and about 4. The temperature of the acid treatment may vary from about 0 to about 150° C., but is preferably between about 60 and about 90° C. The duration of the acid treatment may be 10 minutes to 6 hours, but is preferably about 30 to 120 minutes. The acid treatment may be followed by the addition of magnesium salts, for example, magnesium sulfate, to replenish the magnesium content of the material which under certain conditions has been found to be beneficial.

The chelating agent, that is, a solution containing polydendate ligand molecules, is preferably EDTA, DTPA, DTMPA, or their equivalents, or combinations thereof. The chelate charge is typically at most about 2 kg per ton of pulp but may range from about 0.5 to 5 kg per ton of pulp. During chelate treatment, the pH of the treatment liquid typically varies from a pH of about 2 to about 10, but is preferably between a pH of about 4 and about 8. The temperature of the chelate treatment may vary from 0 to 150° C., but is preferably between about 60 and 110° C. The duration of the chelate treatment may be 10 minutes to 6 hours, but is preferably between about 30 to about 90 minutes.

The chelation stages (Q) and the acid stages (A) are not mutually exclusive; both types of treatments may be used, for example, in succession (in either order) and repeatedly, during the transfer of the slurry of cellulosic material. Either treatment may also be practiced repeatedly. The successive treatments may or may not include a purge or washing stage between successive treatments. For example, some of the treatment sequences that may be practiced according to this invention include, but are not limited to, the following sequences: AA, QQ, AQA, QAQ, AAQ, QQA, AQQ, QAA, AAA, QQQ, AAQQ, QQM. Repetition or extension of these treatment sequences, as would be readily understood by those in the art, is also within the scope of this invention. Again, these sequences may or may not include a washing or purge between successive treatments.

In the embodiment shown in FIG. 5, the acid or chelating agent can be introduced via conduit 782, 788, 912, and/or 914, but the acid or chelate is preferably introduced to subsystem 710 via conduit 782 or to subsystem 810 via conduit 912. If the acid orchelant is added to subsystem 810, the metal removal treatment can be followed immediately by alkaline treatment in subsystem 910 prior to alkaline digestion in, for example, a digester (not shown) fed by conduit 986, with or without the use of a conventional high-pressure feeder.

For example, after treatment or transport in subsystem 710, acid or chelant can be introduced to subsystem 810 via conduit 912, 854, 860, or 882. The acidified/chelated slurry is pressurized by pump 851 and passed to liquor separator 987 via conduit 886. The treatment liquor can be removed via separator 987 and returned upstream of the inlet of pump 851 or, preferably, removed from the system via conduit 988. The metal-laden stream removed via conduit 988 can be passed to other treatment in the pulp mill or to disposal or to any suitable form of conventional metal recovery process. The liquid removed via conduit 988 may be removed simply through a branch conduit from conduit 911 or via a liquor separator, such as an In-line Drainer (not shown). The liquid in conduit 988 may also be removed directly from separator 987. The volume of liquid removed via conduit 988 can be replaced, or "made up", by liquid introduced via conduits 912, 854, 860 and/or 822, for example, water, washer filtrate, black liquor, or bleach plant effluent, among other available liquids. Make-up acid or chelate may also be introduced, with or without make-up liquid, via one or more of the conduits 912, 854, 860, and/or 822.

In addition, according to this invention, the acid or chelant can also be introduced via conduit 782 or conduit 788 so that the metal removal treatment is practiced in the subsystem 710 and a second treatment is practiced in subsystem 810 prior to alkaline treatment in subsystem 910. The second treatment in subsystem 810 may be a second acid or a second chelate treatment, or, if the treatment in subsystem 710 is an acid treatment, the treatment in subsystem 810 may be a chelate treatment, or vice versa.

Furthermore, since the pH of the acid or chelate treatment will typically be distinctly different from the pH of the alkaline treatment (for example, the alkaline treatment is typically practiced at a pH greater than 8, often greater than 10), in order to avoid excessive consumption of acid, chelate, and/or alkali, in one embodiment of the invention, the acid or chelate treatment in a first stage is followed by a wash or neutralization treatment in a following second stage, prior to the subsequent treatment, for example, prior to the introduction of alkaline liquids in a third stage. In the system shown in FIG. 5, the acid or chelate treatment can be practiced in subsystem 710, a somewhat neutral wash or soaking of the material can be practiced in subsystem 810 and an alkaline treatment can be practiced in subsystem 910.

For example, acid or chelant can be introduced via conduit 782 and the acidified/chelated slurry is pressurized by pump 85 and passed to liquor separator 887 via conduit 86. The treatment liquor can be removed via separator 887 and returned to the inlet of pump 85 or, preferably, removed from the system via conduit 888. The metal-laden stream removed via conduit 888 can be passed to other treatment in the pulp mill or to disposal or to a suitable conventional metal recovery process. The liquid removed via conduit 888 may be removed simply through a branch conduit from conduit 88 or via liquor separator, such as a conventional In-line Drainer (not shown). The liquid in conduit 888 may also be removed directly from separator 887. The volume of liquid removed via conduit 888 can be replaced, or "made up", by liquid introduced via conduits 788 and/or 782, for example, water, washer filtrate, black liquor, or bleach plant effluent, among other available liquids. Make-up acid or chelate may also be introduced, with or without make-up liquid, via conduits 788 or 788 or both.

After acid or chelate treatment in subsystem 710, subsystem 810 can be used to wash or neutralize the slurry prior to introducing the slurry to alkaline treatment in subsystem 910. For example, essentially neutral to alkaline, preferably metal-free, liquid can be introduced to the slurry via conduit 912 or conduits 854, 860, or 822, to wash or increase the pH of the slurry during passage through vessel 821 and through conduits 850 and 886 prior to introducing the slurry to separator 987. The neutralized or pH-adjusted liquid is removed from the slurry via separator 987 and the liquid can be returned to upstream of pump 851 via conduit 911 or removed via conduit 988. Again, the liquid removed via conduit 988 may be removed via a simple branch conduit, via a liquor separator (e.g., a conventional In-line Drainer) or directly from separator 987.

After metal removal in subsystem 710 and washing or neutralization in subsystem 810, the cellulose material can be treated with alkaline cooking chemical, for example, kraft white, green, or black liquor (with or without additives as discussed above) in subsystem 910 prior to digestion with minimal excess use of chemical due to consumption of acids and/or chelants by alkali.

Figure 6:
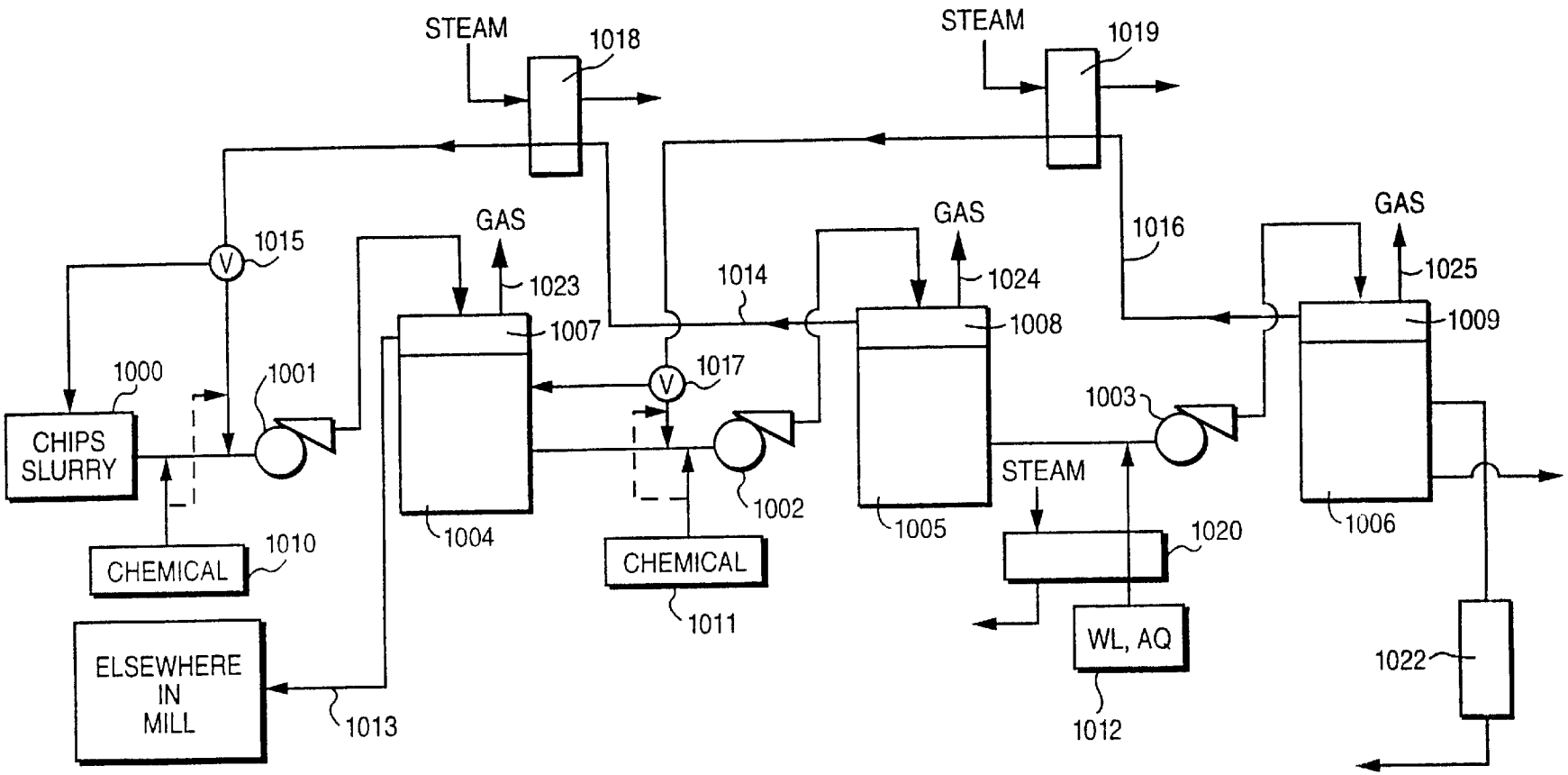
FIG. 6 is a schematic representation of another system that may be used for practicing a method according to the invention.

FIG. 6 schematically illustrates other desirable apparatus for practicing a desirable method according to the invention. Utilizing the system of FIG. 6 a slurry of comminuted cellulosic fibrous material (typically at a consistency of about 5–20%) is transported within a pulp mill at any locations within a fiber line, such as from the wood yard to a digester, with intermittent booster pumps in series. Each pump is associated with a station (treatment vessel) and a solids/ liquid separator is associated with each station (typically a conventional solid/liquid separator at the top of the station), to isolate liquor streams or circulations. Impregnation, or other pretreatment, is performed simultaneously during transit of the material, in the circulation lines (that is from one pump to its associated station), and the lines can be made very long (e.g. more than 100 yards, up to about a half a mile) to facilitate that pretreatment and impregnation. Preferably heat exchangers are utilized on the return lines, and degassing may be provided at one, more than one, or all of the transfer stations. Also, an eductor (ejector) can be used in place a flash tank and/or control valves through which liquor is removed and pressure reduced. Further, pressurized pulsation action may be associated with the configuration of pumps and stations, the pumps pressurizing the slurry to at least 5 bar (typically at least about 10 bar). Also, a wide variety of treatment chemicals may be utilized preferably added upstream of the pumps, including sodium hydroxide, sodium sulfide; polysulfide, anthraquinone or their equivalents or derivatives; surfactants, enzymes, or chelants; or combinations thereof.

The chip slurry 1000 is formed in any conventional manner (including by heat steam slurrying), and first, second and third booster pumps 1001, 1002, and 1003 are connected in series. The pumps 1001–1003 are associated with stations (vessels) 1004, 1005, 1006, respectively. Preferably each of the stations 1004–1006 has a liquid/solid separator associated therewith. In the embodiment illustrated in FIG. 6 separators 1007, 1008, 1009 are shown mounted at the top of each of the stations (treatment vessels) 1004–1006, although the separator could be at another location, including the bottom.

Preferably chemical is added to the slurry at a number of different locations in the system, such as upstream at each of the pumps 1001–1003. This is schematically illustrated by chemical addition at points 1010, 1011, and 1012 in FIG. 6. The same, or different, chemicals can be added at each of 1010–1012. Preferably at least some of the chemical includes sodium hydroxide, sodium sulfide; polysulfide, anthraquinone or their equivalents or derivatives; surfactants, enzymes, or chelants; or combinations thereof. In the embodiment actually illustrated in FIG. 6, the chemical addition 1012 includes AQ laden white liquor (e.g. vessel 1006 is a continuous digester).

Instead of establishing circulation lines such as illustrated in FIG. 5, circulation is provided in the FIG. 6 embodiment, in the preferred form, so as to cause pseudo counter-current flow of the comminuted cellulosic fibrous material and liquid. While FIG. 6 illustrates three stations, any number of stations may be provided. In the embodiment in FIG. 6, the liquid removed from the separator 1007 in line 1013, is used elsewhere in the mill, or treated for reuse. The liquid removed from separator 1008 passes in line 1014 to a point upstream of the pump 1001 (e.g. it is diverted by the valve 1015 either to the slurrying station 1000, or to the infeed to the pump 1001) while liquid separated by the third separator 1009 is circulated in line 1016 to upstream of the pump 1002, e.g. diverted by the valve 1017 to the first station 1004, and/or to just upstream of the pump 1002. Fresh liquor, from source 1012, is added to the bottom of the vessel 1005, or the intake of the pump 1003.

In the return lines 1014, 1016, conventional indirect heat exchangers 1018, 1019 may be provided which change the temperature of the liquid therein by at least 5° C. In the embodiment illustrated, the liquor is heated, but in some circumstances the liquid could be cooled instead of heated. A indirect heat exchanger 1020 may be also be associated with the chemical addition 1012.

Liquor can be passed from the third station 1006 (which may be a digester—e.g. black liquor) through a conventional eductor (ejector) 1022, rather than a flash tank and/or control valves. Each of the pumps 1001–1003 preferably pressurizes the slurry to a pressure of at least 5 bar (typically at least about 10 bar).

Degassing may also be associated with one, more than one, or all of the stations 1004. This is schematically illustrated by the gas removal lines 1023–1025 in FIG. 6. Degassing may be accomplished using any conventional degassing equipment, associated with the separator 1007–1009, the inlet line, or the like.

Figure 7:
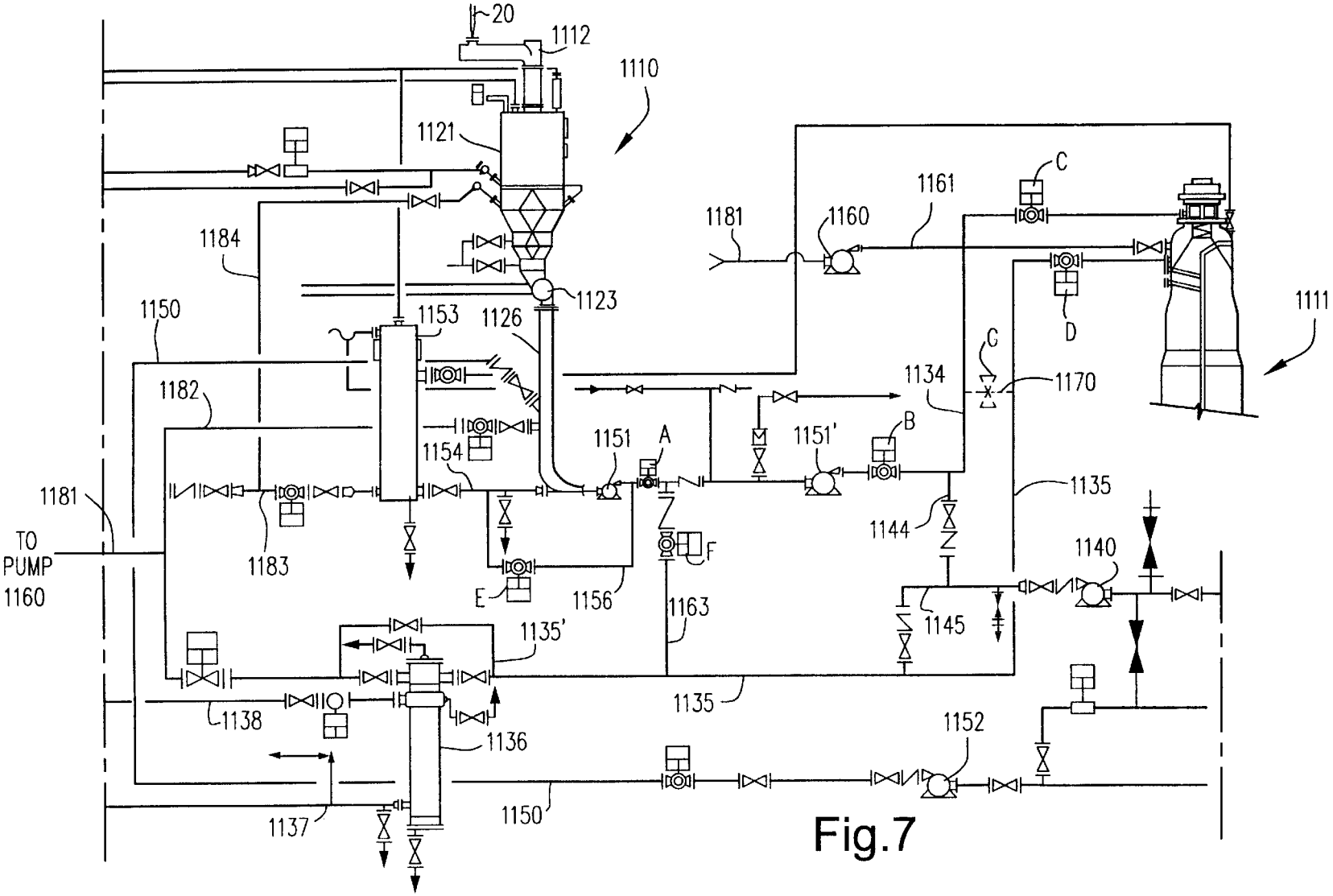
FIG. 7 is a schematic illustration of another typical system for feeding a slurry of comminuted cellulosic fibrous material to a digester, according to the invention.

FIG. 7 schematically illustrates a continuous digester feed system similar to the system illustrated in FIG. 3. Some of the significant differences between the system of FIG. 7, and the method practiced thereby, and the system of FIG. 3, and the method practiced thereby, are the provision of a cooling heat exchanger and a return line from the digester to one or more pumps, a return conduit for introducing liquor directly into the chip tube (by bypassing the surge tank), and a recirculation conduit from the outlet of one or each slurry pump (including the first pump) ultimately to the inlet thereof (e.g. connected between the surge tank and the chip tube for the first pump) to establish a recirculation flow that is particularly desirable during the startup operation.

It is to be understood that though a continuous digester is illustrated in FIG. 7, the present invention is also applicable to a batch digester system. The system shown in FIG. 7 includes a feed system 1110 feeding a digester 1111. The feed system 1110 includes an air-lock chip feed screw 1112, for accepting wood chips 20, and chip bin 1121. Feed screw 1112 is preferably the device disclosed in U.S. Pat. No. 5,766,418 and bin 1121 is marketed under the name Diamondback® Steaming Vessel or Bin as discussed above. Other types of conventional steaming vessels, for example, horizontal screw conveyors or VibraBin vessels having a vibrating discharge, may also be used in place of a Diamondback Bin.

Similar to the system shown in FIG. 3, the system shown in FIG. 7 includes a metering device 1123, such as a Chip Meter, a vertical conduit 1126, such as a Chip Tube, and a liquor storage vessel 1153, such as Liquor Surge Tank. Also, as shown in FIG. 3, the system of FIG. 7 includes a first pump, or pumping device, 1151 and a second pump, or pumping device, 1151', which again, may be any type of pump or pumping device for pressurizing and transferring a slurry of comminuted cellulosic fibrous material and liquid. One preferred pumping device is a Hidrostal screw-feed-type pump provided by Wemco Pump of Salt Lake City, Utah, [http://www.wemcopump.com/Products/hidrostal/details.html] or a pump provided by Lawrence Pumps Inc. of Lawrence, Mass. [http://www.lawrencepumps.com/]. Similar to the system shown in FIG. 3, the inlet of pump 1151 is in operative communication or is connected directly to the outlet of vertical conduit 1126 and the outlet of pump 1151 is in operative communication with or is connected to the inlet of pump 1151'. The outlet of pump 1151' is operative communication with the inlet of digester 1111 via conduit 1134. Excess liquor is returned from the digester 1111 to the feed system 1110 from the inlet of the digester, or from any other available source of liquid associated with the digester, via conduit 1135.

Figure 8:
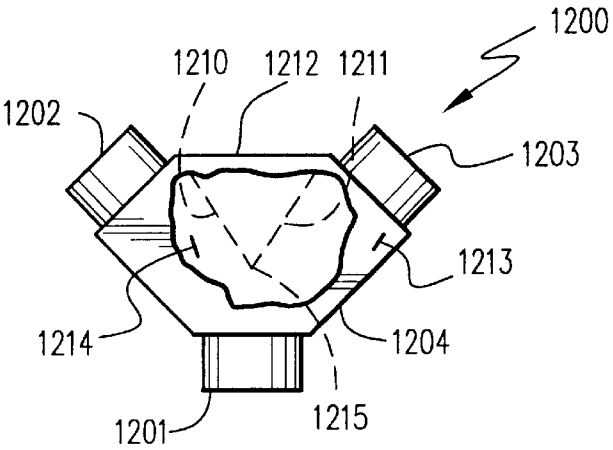
FIG. 8 is a side view, with a portion of the near wall of the flow chamber cut away so as to illustrate the interior thereof, of an exemplary flow splitter according to the present invention.

Though not shown in FIG. 7, it would be recognized by those familiar with the art, that the present invention may also be practiced by having the one or more pumps 1151 feed two or more pumps 1151' for feeding one or more digesters 1111. This mode of operation may be particularly suitable for feeding a plurality of batch digesters, but may also be applicable to feeding two or more continuous digesters. One device that can be used to split the flow from one conduit to two or more conduits is shown in FIG. 8. It is also recognized that the present invention may also incorporate the features of the inventions disclosed in U.S. Pat. No. 5,795,438, the disclosure of which is incorporated in its entirety by reference herein.

Liquor in conduit 1135 is returned to various locations in the feed system 1110. The liquor in conduit 1135 is preferably returned to Chip Tube 1126 via conduit 1182 or to tank 1153 via conduit 1183 or to vessel 1121 via conduit 1184. Since the liquor in conduit 1135 will typically have a temperature greater than 100° C. and the Chip Tube 1126 and vessel 1153 may operate at approximately atmospheric pressure, that is, −1 to 1 bar gage (that is, 0 to 2 bar absolute), to avoid undesirable rapid evaporation (that is, "flashing"), some form of cooling device 1136 is provided. This cooling device is preferably an indirect liquor-to-liquor cooling heat exchanger, and cools the liquid being returned to below the temperature at which it will flash. The cooling medium provided in conduit 1137 is typically any available cool liquid stream in the pulp mill. One preferred cooling medium is fresh water which is introduced via conduit 1137 to heat exchanger 1136 at one temperature and removed via conduit 1138 at a higher temperature. Cooking liquids, for example, kraft white, green, or black liquor (for example, via conduit 1150) may also be used as the cooling medium in heat exchanger 1136. A bypass conduit 1135' may also be used to divert liquor around heat exchanger 1136 when the heat exchanger is not needed or when it is being serviced.

The level of liquid in tank 1153 is typically controlled by a level control mechanism, for example, a level control mechanism using a d-p cell level indicator or a gamma radiation level indicator (not shown). The level in tank 1153 is typically controlled by varying the flow of liquid out of branch conduit 1181 which feeds pump 1160, that is, the Make-up Liquor pump. Pump 1160 pressurizes and introduces this excess liquor to the top of the digester 1111 via conduit 1161.

Liquor in conduit 1135 may also be introduced, with or with heating or cooling, upstream of pump 1151 via conduit 1163. Conduit 1163 may have a valve F. The benefit of introducing pressurized liquid from conduit 1135 upstream of pump 1151 is discussed above in the description of FIG. 3. The present invention also preferably includes a conduit 1156 between the outlet of pump 1151 and conduit 1154 which may have a valve E, so that liquor may flow from line 1156 to line 1154.

Liquor may also be introduced to conduits 1134 and 1135 via conduits 1144 and 1145 during normal operation or during shutdown or startup of the system. For example, weak black liquor or "cold blow" liquor from pump 1140 may be introduced to conduits 1134 and 1135 to flush the lines during shutdown or to introduce additional liquor to the lines as needed, for example, for liquor-to-wood ratio control or black liquor pretreatment, during normal operation. Cooking liquor, for example, kraft white liquor, green liquor, black liquor, orange liquor, or liquor containing strength or yield enhancing additives, such as anthraquinone, polysulfide, chelants, surfactants, sulfur, or their derivatives and equivalents, may be added to feed system 1110 via conduit 1150 and pump 1152. The liquor in conduit 1150 is preferably added to Chip Tube 1126 as shown, but can also be added to conduits 1134 or 1135.

The system shown in FIG. 7 also includes several valves, either automatically controlled or manual, which isolate the flow of liquids and their pressures from each other. Valve A isolates the outlet of pump 1151 from the inlet of pump 1151'. Valve B isolates the outlet of pump 1151' from the digester 1111. Valve C in conduit 1134 isolates the feed conduit to the digester 1111 from the digester and valve D in conduit 1135 isolates the return conduit 1135 from the digester 1111. These valves are especially important during upset conditions to isolate the hot pressurized liquids associated with the digester 1111 from the lower pressure feed system 1110 and from the surrounding personnel and adjacent machinery.

The valves A–F, along with selected other valves, can also be used to isolate liquor circulations to aid in start-up and shutdown procedures. For example, when valve A is closed and valve E in conduit 1156 is open, pump 1151 can be started and a closed circulation about pump 1151 can be established via conduit 1156. Similarly, when valve A is closed and valves C, D, and F are opened and pump 1151' is started, a circulation about pump 1151' can be provided via conduit 1134, the top of digester 111, conduit 1135, and conduit 1163. (It is also possible to isolate the circulation about pump 1151 from the digester 1111 by inserting a conduit 1170, with an appropriate valve G, in conduit 1170 between conduits 1134 and 1135.)

The conduits 1156, 1154 (and preferably the isolating Valves A and E), and associated connections to other components, comprise means for circulating liquid from the pump 1151 outlet back to its inlet. While conduits are shown as such means it is to be understood that any conventional structures which provide this recirculation may be utilized, including tanks, ejectors, pumps, valves, ducts, heat exchangers, or the like.

Isolation of these circulations is especially advantageous during start-up and shutdown conditions when these isolations can be separately maintained. For example, during start-up, before the introduction of wood chips, the two pumps 1151, 1151' can be operated to establish one circulation about pump 1151 via conduit 1156 and a second circulation about pump 1151' passing through the digester top and conduits 1134 and 1135. By so doing, the proper operation of each pump 1151, 1151' can be verified and also the pressures and temperatures of each circulation can be isolated. For example, the temperature and pressure of the liquid in the circulation in conduits 1134 and 1135 can be raised to digester operating conduits, for example, 7–15 bar gage at 100–160° C., while the temperature of the circulation associated with pump 1151 and conduit 1156 can be maintained at lower conditions, for example, 1–3 bar gage at 60–120° C., Then when the conditions in each circulation agree, for example, the liquor in conduits 1134 and 1156 are both at about 10 bar gage and 120° C., valve A can be gradually opened while valve E is gradually closed and chips can be introduced to feed system 1110. A similar situation can occur during shutdown or when the digester 1111 and/or feed system 1110 need to be isolated for servicing.

Feed system 1110 may also include a centrifugal separator for removing sand and debris, for example, a Sand Separator; a liquor/chips separator, for example, an In-line drainer; or a liquor storage vessel, for example, a Level Tank, if needed, as found in conventional systems. One or all of these devices may also be omitted from the embodiment shown in FIG. 7.

Feed system 1110 may also include an integral Chip Tube and Surge Tank, as well as other simplifications to a feed system, as disclosed in co-pending application Ser. No. 09/520,761 filed on Mar. 7, 2000, the disclosure of which is incorporated by reference in its entirely herein.

Figure 10:
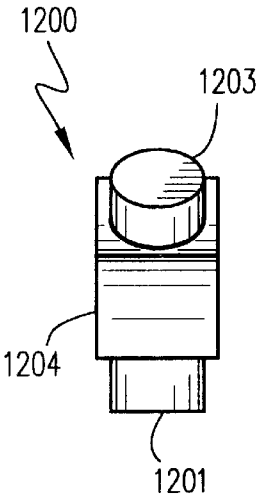
FIGS. 9 and 10 are top and end views of the flow splitter of FIG. 8.
Figure 9:
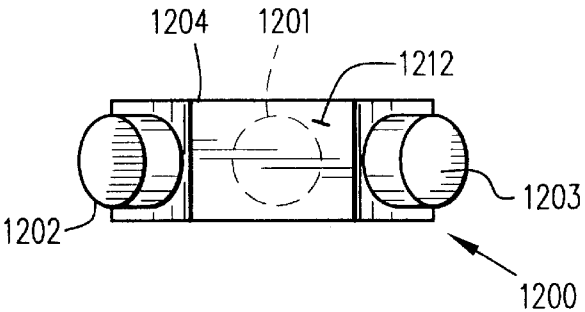

FIGS. 8–10 illustrate another embodiment of the present invention for dividing the flow of slurry in a pipe line. FIG. 8 illustrates an elevation view, FIG. 9 a top view, and FIG. 10 a right-hand elevation view. The device 1200 shown in FIGS. 8–10, which is referred to as a static "flow divider" or "flow splitter", can, for example, be inserted in conduit 34 of FIGS. 1 and 2, conduit 252 or 234 of FIG. 3, conduit 86 and 886 of FIGS. 4 and 5, or corresponding conduits in FIG. 6, or conduit 1134 in FIG. 7.

The static flow splitter 1200 includes an inlet 1201 for a flow of a slurry of comminuted cellulosic fibrous material and liquid and two or more outlets 1202, 1203. The inlet and outlets are preferably circular in cross section, but may be non-circular depending upon the needs of the installation, including elliptical, rectangular, square, or even triangular. The device 1200 includes a chamber 1204 for receiving the slurry from the inlet 1201 and discharging the slurry to the two or more outlets 1203, 1204. The chamber 1204 can have any appropriate cross sectional shape, including round, elliptical, rectangular, square, or triangular, but the shape of the chamber preferably limits the areas in which material in the slurry can stagnate, for example, sharp corners are avoided. As shown in FIG. 8, one preferred shape of chamber 1204 is substantially triangular in which the outlets 1202, 1203 have centerlines that diverge from the centerline of the inlet 1201 by between about 30 and 60°, for example, by about 45°.

The chamber 1204 may also include one or more internal baffle plates 1210, 1211 (shown in phantom) in FIG. 8 to aid in directing the flow of slurry to the two or more outlets 1202, 1203. These baffle plates 1210, 1211 may define a triangle with the wall 1212, positioned opposite the inlet 1201 of device 1200. The ends of the plates 1210, 1211 may be welded or otherwise attached to the walls 1213, 1214 of the chamber 1204. In the embodiment illustrated in FIG. 8 the apex 1215 of the substantially triangular baffle plate arrangement 1210, 1211 is substantially aligned with the inlet 1201. The flow splitter 1200 is static, i.e. has no moving parts (although the position of the baffle plate arrangement 1210, 1211 may be made adjustable).

The dimensions of device 1200 will vary depending upon the given or desired dimensions and production rate of the system in which it is used. The dimension, for example diameter, of the inlet 1201, and the outlets 1202, 1203, may range from 2 inches to 10 feet. For example, the inside diameter of the inlet and outlets is about 10 inches. The dimensions of the chamber 1204 will be essentially dictated by the dimensions of the inlet and outlet, an may also vary from about 2 inches to about 10 feet, for example, the chamber 1204 shown in FIGS. 8–10 has a width of about 13 inches.

Device 1200 is typically made of any appropriate material that can withstand the hot (for example, 400° F. or hotter), pressurized (for example, 300 psig or greater), corrosive (either acidic or alkaline) slurries that are typically handled in a pulp and paper mill, including metals and high-performance plastics. However, the device is preferably made of metal, in particular steel, and is preferably made from weldable stainless steel, for example 304L (having an ASTM designation ASTM-A240-304L), or its equivalents, or better.

In use, the inlet 1201 is connected to the conduit 34, 252, 234, 86, 856, 1134, and one outlet 1202 is connected to the same conduit while the other outlet 1203 is connected to a conduit leading to the same or another digester (batch or continuous). Where only two outlets 1202, 1203 are provided preferably about one-half the inlet flow goes to each, although the plates 1202, 1203 may be dimensioned or positioned, so that a higher volume flow goes through one outlet 1202, 1203 than the other.

In the broadest aspect of this invention, a system and method are provided for the multistage transport and treatment of comminuted cellulosic fibrous material with the economical recovery and re-use of energy, including thermal energy.

The invention also specifically includes all narrower ranges within a broad range. For example, at a temperature of between 60–90° C. means 61–89° C., 68–74° C., 65–82° C., and all other narrow ranges within that broad range.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of treating a slurry comminuted cellulosic fibrous material using at least first and second series connected pumps, and at least first and second in-series stations, each with a solids/liquid separator, in which the metal content of the material is reduced, comprising:

(a) pumping the slurry of comminuted cellulosic fibrous material using the series connected pumps;

(b) separating some liquid from the slurry at each station to substantially isolate liquor circulations and streams, and to recirculate removed liquid from at least one of the stations to upstream of one of the pumps; and (c) adding to the slurry at or upstream of at least one of the pumps chemicals which dissolve or sequester metal containing compounds in the slurry, the chemicals including at least one chemical selected from the group consisting essentially of acids, chelating agents, and combinations thereof, so that at least some of the metals present in the material prior to the treatment are removed from the material.

2. A method as recited in claim 1 wherein (c) is practiced to dissolve at least about 10% of the metals in the slurried material.

3. A method as recited in claim 2 further comprising (d) removing at least some of the liquid from the slurry during (a) or (b) to purge at least some of the metal containing compounds from the liquor circulations.

4. A method as recited in claim 3 wherein (d) is practiced to purge at least about 20% of the metals in the slurried material.

5. A method as recited in claim 4 further comprising, after (a)–(d), (f) treating the material with an alkaline liquid, and (g) digesting the material in an alkaline digestion process.

6. A method as recited in claim 1 further comprising (d) removing at least some of the liquid from the slurry during (a) or (b) to purge at least some of the metal containing compounds from the liquor circulations.

7. A method as recited in claim 6 wherein (d) and (d) are practiced to purge about 20–80% of the metals in the slurried material.

8. A method as recited in claim 6 wherein (b) and (d) are practiced at substantially the same time and using substantially the same equipment.

9. A method as recited in claim 8 further comprising (e) introducing liquid to the circulation to substantially replace the liquid removed in (d).

10. A method as recited in claim 9 further comprising after (a)–(e), (f) treating the material with an alkaline liquid, and (g) digesting the material in an alkaline digestion process.

11. A method as recited in claim 6 further comprising (e) introducing liquid to the circulation to substantially replace the liquid removed in (d).

12. A method as recited in claim 11 wherein (e) is practiced substantially immediately downstream of where (d) is practiced.

13. A method as recited in claim 12 wherein (e) is practiced in conjunction with (c) so that replacement liquid is introduced substantially with the treatment chemical.

14. A method as recited in claim 11 further comprising after (a)–(e), (f) treating the material with an alkaline liquid, and (g) digesting the material in an alkaline digestion process.

15. A method as recited in claim 14 wherein (a)–(e) are practiced substantially immediately prior to (f) and (g).

16. A method as recited in claim 14 wherein the chemical used to effect (c) is introduced at or upstream of the first pump and the chemical used to effect (f) is introduced at or upstream of the second pump.

17. A method as recited in claim 6 further comprising, after (a)–(d), (f) treating the material with an alkaline liquid, and (g) digesting the material in an alkaline digestion process.

18. A method as recited in claim 17 wherein (a)–(d) are practiced immediately prior to (f) and (g).

19. A method as recited in claim 17 wherein the chemical used to effect (c) is introduced at or upstream of the first pump and the chemical used to effect (f) is introduced at or upstream of the second pump.

20. A method as recited in claim 6 wherein (c) and (d) are practiced to acid treat the material at a pH of about 2–4 at a temperature between 60–90° C., for a duration of about 30–120 minutes.

21. A method as recited in claim 6 wherein (c) and (d) are practiced to chelate treat the material at a pH of between about 4–8, at a temperature of between about 60–110° C., for a duration of between about 30–90 minutes.

22. A method as recited in claim 1 wherein (c) is practiced to acid treat the material at a pH of about 2–4 at a temperature between 60–90° C., for a duration of about 30–120 minutes, or wherein (c) and (d) are practiced to chelate treat the material at a pH of between about 4–8, at a temperature of between about 60–110° C., for a duration of between about 30–90 minutes.

* * * * *